US012290728B2

(12) United States Patent
Mason et al.

(10) Patent No.: US 12,290,728 B2
(45) **Date of Patent: *May 6, 2025**

(54) MOLDED HOCKEY PUCK WITH ELECTRONIC SIGNAL TRANSMITTER CORE

(71) Applicant: SportsMEDIA Technology Corporation, Durham, NC (US)

(72) Inventors: Kent Mason, San Jose, CA (US); Richard H. Cavallaro, Mountain View, CA (US); Jim Doeden, Pleasanton, CA (US)

(73) Assignee: SportsMEDIA Technology Corporation, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/752,401

(22) Filed: May 24, 2022

(65) Prior Publication Data

US 2022/0280852 A1 Sep. 8, 2022

Related U.S. Application Data

(63) Continuation of application No. 16/503,061, filed on Jul. 3, 2019, now Pat. No. 11,344,778, which is a (Continued)

(51) Int. Cl.
*A63B 67/14* (2006.01)
*A63B 24/00* (2006.01)
(Continued)

(52) U.S. Cl.
CPC ..... *A63B 67/14* (2013.01); *A63B 24/0021* (2013.01); *A63B 43/00* (2013.01);
(Continued)

(58) Field of Classification Search
CPC ... A63B 43/06; A63B 43/004; A63B 24/0021; A63B 2102/22; A63B 2102/24;
(Continued)

(56) References Cited

U.S. PATENT DOCUMENTS 2,020,484 A * 11/1935 Turner ..... A63B 43/06 473/570
2,425,966 A 8/1947 Tjomsland
(Continued)

FOREIGN PATENT DOCUMENTS

CN 205042066 U * 2/2016
EP 819452 B1 * 11/2003 ..... A63B 43/00
(Continued)

*Primary Examiner* — Melba Bumgarner
*Assistant Examiner* — Amir A Klayman
(74) *Attorney, Agent, or Firm* — NEO IP

(57) ABSTRACT

A hockey puck is disclosed including an internal signal transmitter enabling instantaneous identification of its position as it moves around. The hockey puck includes two molded subcomponents, which encapsulate the signal transmitter. The signal transmitter includes driver electronics and a number of signal transmitters which together generate and emit an electromagnetic signal. The electromagnetic signal is emitted by a plurality of diodes mounted in cavities in the subcomponents, for example around an outer circumference of the hockey puck and through a top and bottom surfaces of the hockey puck. The hockey puck is alternatively formed of a material that allows electromagnetic radiation to be emitted through the subcomponents, and the diode cavities omitted.

12 Claims, 26 Drawing Sheets

Related U.S. Application Data continuation of application No. 16/027,594, filed on Jul. 5, 2018, now Pat. No. 10,343,042, which is a continuation of application No. 15/260,122, filed on Sep. 8, 2016, now Pat. No. 10,016,669.

(51) Int. Cl.
*A63B 43/00* (2006.01)
*A63B 71/06* (2006.01)
*A63B 102/24* (2015.01)

(52) U.S. Cl.
CPC ..... *A63B 71/06* (2013.01); *A63B 43/008* (2013.01); *A63B 2102/24* (2015.10)

(58) Field of Classification Search
CPC ... A63B 67/14; A63B 69/0026; A63B 43/008; A63B 43/00; A63B 71/06
See application file for complete search history.

(56) References Cited

U.S. PATENT DOCUMENTS 2,640,699 A 6/1953 Garbo
3,580,575 A * 5/1971 Speeth ..... A63B 43/06 482/84
3,679,212 A 7/1972 Smith
3,704,891 A 12/1972 Chiarelli
3,786,246 A * 1/1974 Johnson ..... A63H 33/18 473/588
4,002,893 A * 1/1977 Newcomb ..... A63B 43/06 446/438
4,078,801 A 3/1978 White
4,132,031 A * 1/1979 Psyras ..... A63H 33/26 446/47
4,153,253 A 5/1979 White
4,183,536 A 1/1980 Platt
4,431,196 A * 2/1984 Kutnyak ..... A63H 33/18 473/588
4,736,943 A 4/1988 Fukuda et al.
4,846,475 A 7/1989 Newcomb et al.
4,878,668 A 11/1989 Nevoral
4,963,117 A * 10/1990 Gualdoni ..... A63B 43/06 473/610
4,968,036 A 11/1990 Mark
4,991,847 A 2/1991 Rudell et al.
5,014,990 A 5/1991 Kaser et al.
5,032,098 A * 7/1991 Balogh ..... A63H 33/18 473/588
5,054,778 A * 10/1991 Maleyko ..... H05B 45/00 446/485
5,066,012 A * 11/1991 Stark ..... A63B 43/06 362/369
5,102,131 A * 4/1992 Remington ..... A63B 43/06 446/438
5,186,458 A * 2/1993 Redondo ..... A63B 43/06 446/485
5,207,720 A 5/1993 Shepherd
5,348,298 A 9/1994 Montgomery
5,366,219 A 11/1994 Salcer et al.
5,388,825 A 2/1995 Myers et al.
5,408,264 A 4/1995 Kurata et al.
5,408,764 A * 4/1995 Wut ..... A43B 3/36 36/137
5,429,359 A 7/1995 Timperman et al.
5,518,237 A 5/1996 Bellehumeur
5,526,326 A 6/1996 Fekete et al.
5,564,698 A 10/1996 Honey et al.
5,564,702 A * 10/1996 Meffert ..... A63F 9/0415 273/153 R
5,615,880 A * 4/1997 Booth ..... A63B 24/0021 473/570
5,649,758 A 7/1997 Dion
5,718,648 A 2/1998 La Savio
5,743,815 A 4/1998 Helderman
5,792,012 A 8/1998 Dudley
5,910,057 A 6/1999 Quimby et al.
5,912,700 A 6/1999 Honey et al.
5,946,643 A 8/1999 Zakutin
5,976,042 A 11/1999 LaMarche et al.
6,042,487 A 3/2000 Schrimmer et al.
6,089,998 A 7/2000 O'Neal et al.
6,113,504 A * 9/2000 Kuesters ..... G01S 5/0081 473/200
6,117,030 A 9/2000 Green
6,126,561 A 10/2000 Mark
6,252,632 B1 * 6/2001 Cavallaro ..... H04N 5/262 348/592
6,428,432 B1 8/2002 Kachel
6,450,661 B1 9/2002 Okumura
6,575,855 B1 * 6/2003 Buzak ..... A63B 43/06 273/DIG. 8
6,626,554 B2 9/2003 Rincover et al.
6,666,782 B1 * 12/2003 Wu ..... A63H 33/22 446/485
6,726,580 B2 * 4/2004 Peterson ..... A63B 41/00 473/570
6,733,149 B1 * 5/2004 Chuang ..... A63B 43/06 446/175
6,770,012 B2 8/2004 Kuo
6,783,421 B1 * 8/2004 Lopez ..... A63H 23/10 446/485
6,799,862 B2 10/2004 Galli
6,959,998 B2 11/2005 Tsukamoto
7,088,222 B1 8/2006 Dueker et al.
7,163,313 B2 * 1/2007 Rosenberg ..... F21V 15/01 362/186
7,261,432 B1 8/2007 Habitz
7,785,215 B2 8/2010 Kohnen
7,811,163 B2 10/2010 Ratcliffe
7,849,740 B2 * 12/2010 Nichol ..... G01P 1/02 473/588
8,622,857 B2 1/2014 Lo
8,727,918 B1 5/2014 Gentile
8,727,919 B1 * 5/2014 Gentile ..... A63B 43/06 473/570
D720,012 S 12/2014 Ishiwata
9,022,620 B2 * 5/2015 Brinzey ..... F41H 13/0087 362/253
9,046,229 B2 6/2015 Bennett et al.
9,192,821 B2 * 11/2015 Smith ..... A63B 43/002
9,227,112 B2 1/2016 Kodama et al.
9,279,557 B2 3/2016 Su
9,320,981 B2 4/2016 Dawson
9,463,360 B1 * 10/2016 Richard ..... A63B 43/06
9,498,680 B2 11/2016 Luciano, Jr. et al.
9,557,038 B2 1/2017 Blair et al.
9,596,829 B2 3/2017 Wolfe, Jr. et al.
9,597,565 B2 * 3/2017 Forutanpour ..... A63B 71/06
9,597,569 B2 3/2017 Pederson
9,674,435 B1 6/2017 Monari et al.
9,757,633 B2 * 9/2017 Bauman ..... A63B 67/14
9,791,246 B2 10/2017 D'Andrade
9,873,064 B1 1/2018 Adkins et al.
10,029,155 B1 7/2018 Lo
D827,219 S 8/2018 Yan et al.
10,507,374 B2 12/2019 Kounellas
10,537,778 B2 1/2020 Mayer et al.
10,675,526 B2 * 6/2020 Moyerman ..... A63B 71/0605
10,722,773 B2 7/2020 Houlihan
11,161,027 B2 * 11/2021 Kounellas ..... A63B 71/0605
11,344,778 B2 5/2022 Mason et al.
11,395,953 B2 * 7/2022 Kounellas ..... A63B 67/14
2002/0137582 A1 9/2002 Yu
2004/0022070 A1 2/2004 Moore
2004/0138595 A1 7/2004 Fang
2005/0085316 A1 4/2005 Barr
2005/0261083 A1 * 11/2005 Liao ..... A63B 24/0021 473/570
2007/0247439 A1 10/2007 Daniel et al.
2007/0275801 A1 11/2007 Proulx et al.
2007/0289553 A1 12/2007 Jager

(56) References Cited

U.S. PATENT DOCUMENTS

2008/0039246 A1 2/2008 Martino
2011/0214616 A1 9/2011 Levin et al.
2011/0244981 A1 10/2011 Schrimmer et al.
2012/0169589 A1 7/2012 Albano et al.
2012/0287611 A1 11/2012 Wilson et al.
2013/0025543 A1 1/2013 Ottosson
2013/0115400 A1 5/2013 Chou
2013/0167290 A1 7/2013 Ezra
2013/0196788 A1 8/2013 Shimizu et al.
2013/0210562 A1 8/2013 Zawitz
2013/0337948 A1* 12/2013 Smith ..... A63B 43/002 473/570
2014/0127967 A1 5/2014 Liao
2014/0194232 A1 7/2014 Krysiak et al.
2014/0194258 A1 7/2014 Shorter
2014/0309059 A1* 10/2014 Minch ..... A63B 69/0053 473/422
2015/0246266 A1* 9/2015 Zawitz ..... A63H 33/22 473/612
2016/0273738 A1 9/2016 Wolfinbarger
2016/0332052 A1* 11/2016 Bauman ..... A63B 67/14
2017/0100645 A1* 4/2017 Larson ..... A63H 27/10
2017/0246513 A1 8/2017 Fang
2018/0065012 A1 3/2018 Mason et al.
2018/0104563 A1* 4/2018 Kounellas ..... A63B 63/004
2018/0326276 A1 11/2018 Mason et al.
2019/0036360 A1 1/2019 Zilles et al.
2019/0271572 A1* 9/2019 Yang ..... G01D 5/2006
2019/0344143 A1 11/2019 Mason et al.
2020/0276487 A1 9/2020 Hall et al.
2020/0324185 A1 10/2020 Hulkki
2020/0398111 A1 12/2020 Near
2021/0077862 A1 3/2021 Hutt
2022/0370875 A1* 11/2022 Hurwitz ..... A63B 69/0026

FOREIGN PATENT DOCUMENTS

KR 200265765 Y1 * 2/2002 ..... A63B 69/0084
KR 20190119949 * 10/2019

* cited by examiner

Fig. 13
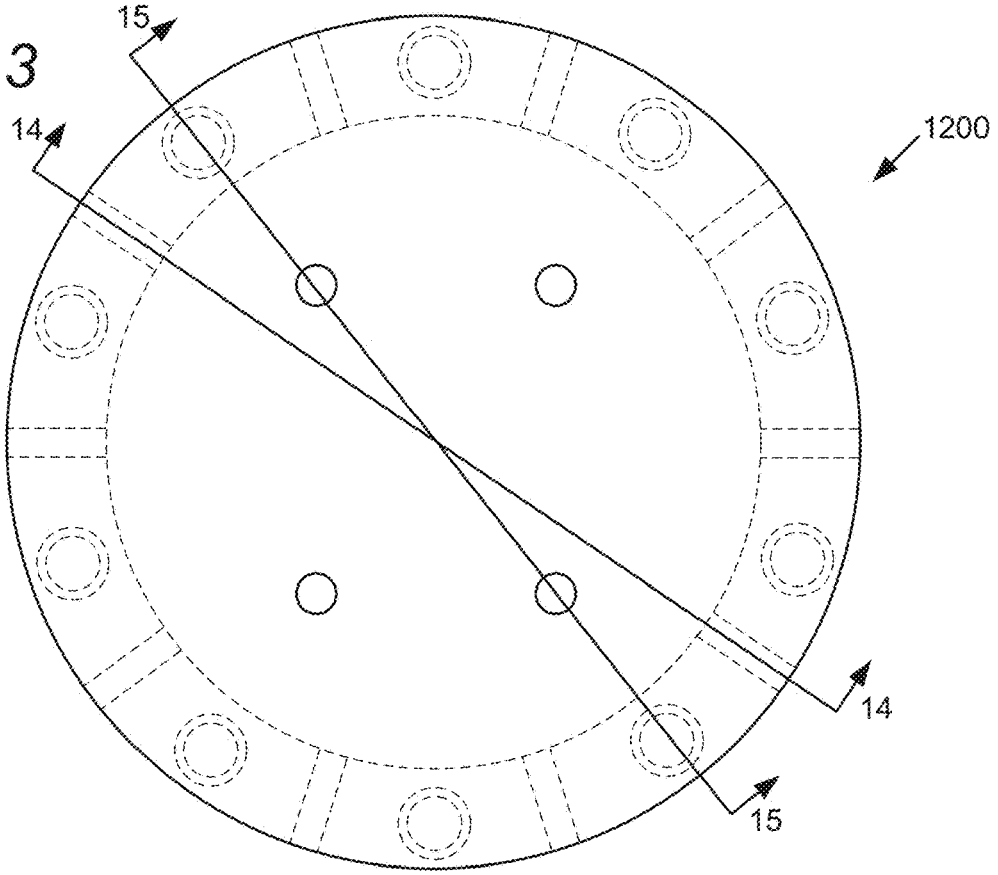
Fig. 14 (Line 14-14)
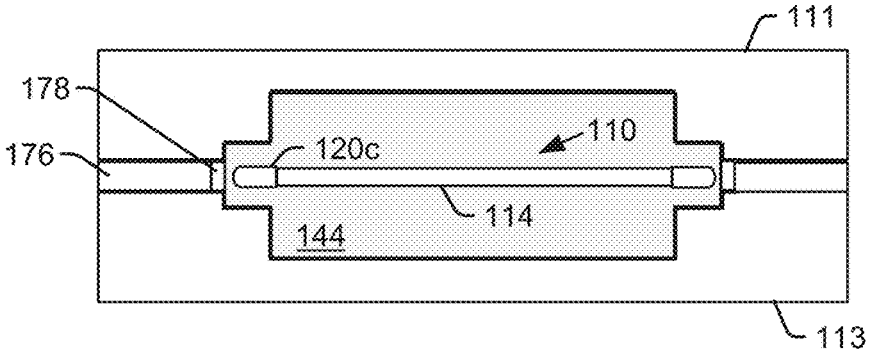
Fig. 15 (Line 15-15)
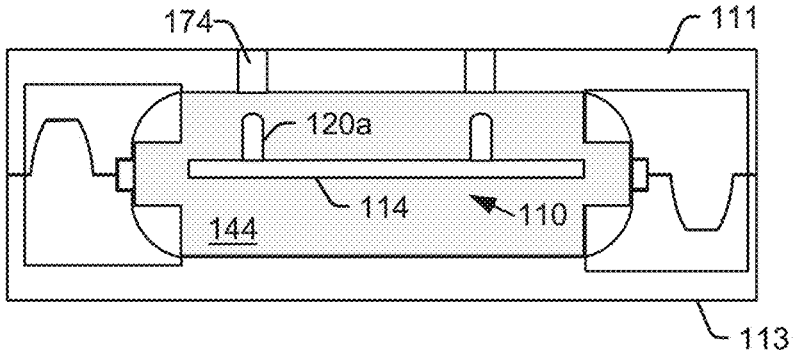

Fig. 16
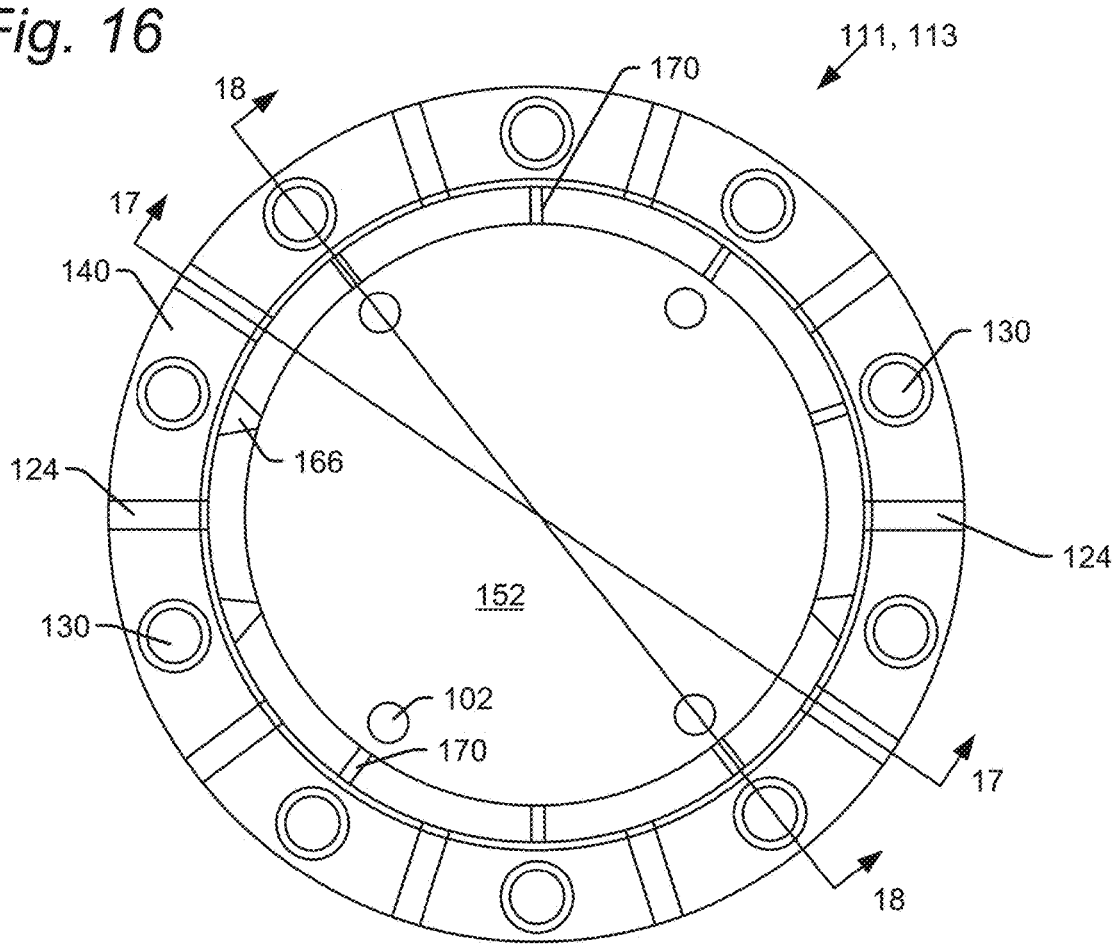
Fig. 17 (Line 17-17)
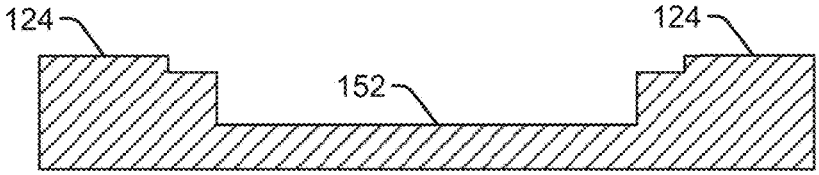
Fig. 18 (Line 18-18)
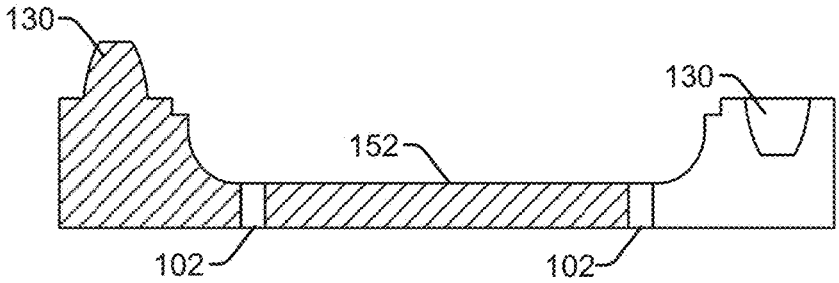

*Fig. 22*
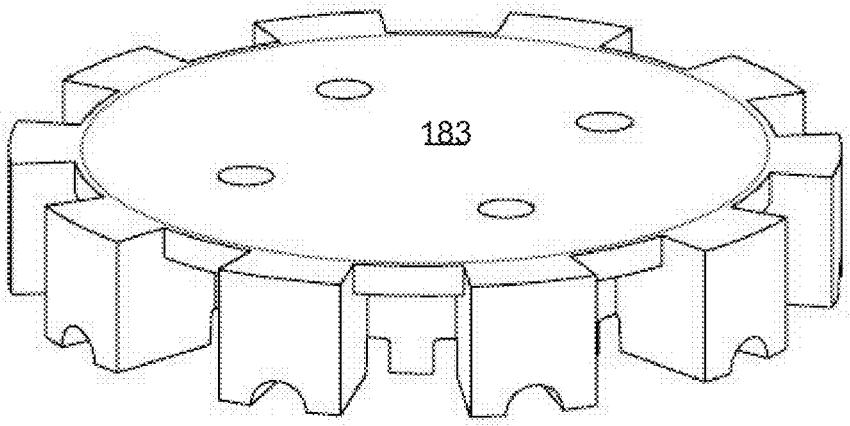
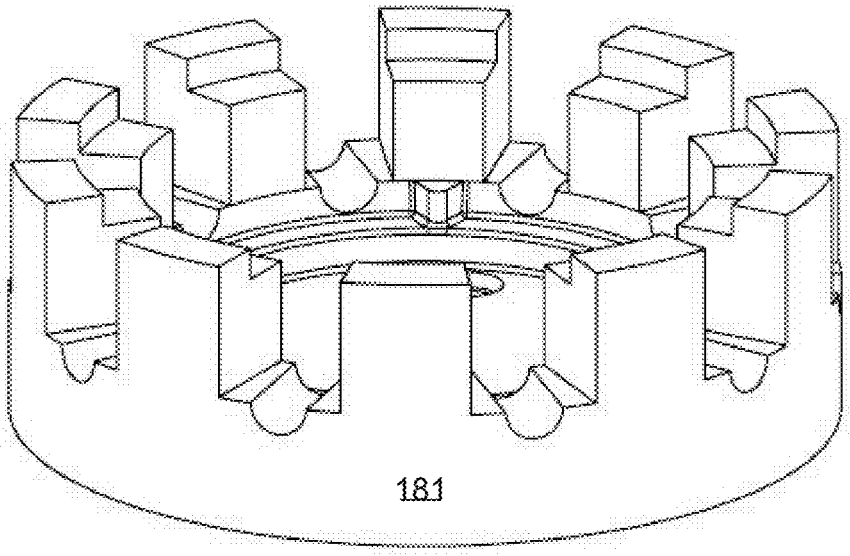

Fig. 28
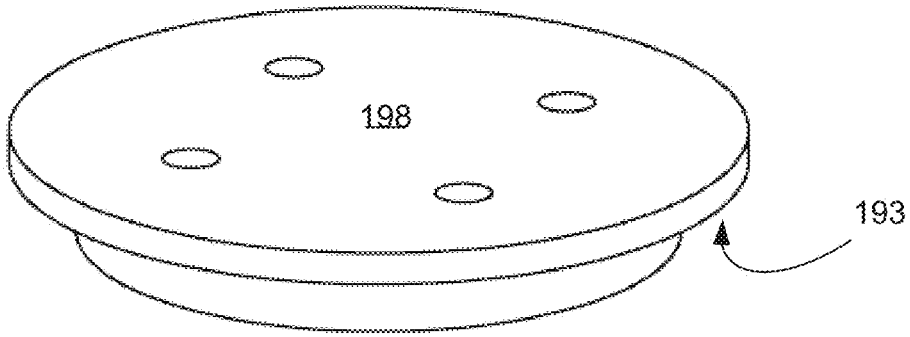
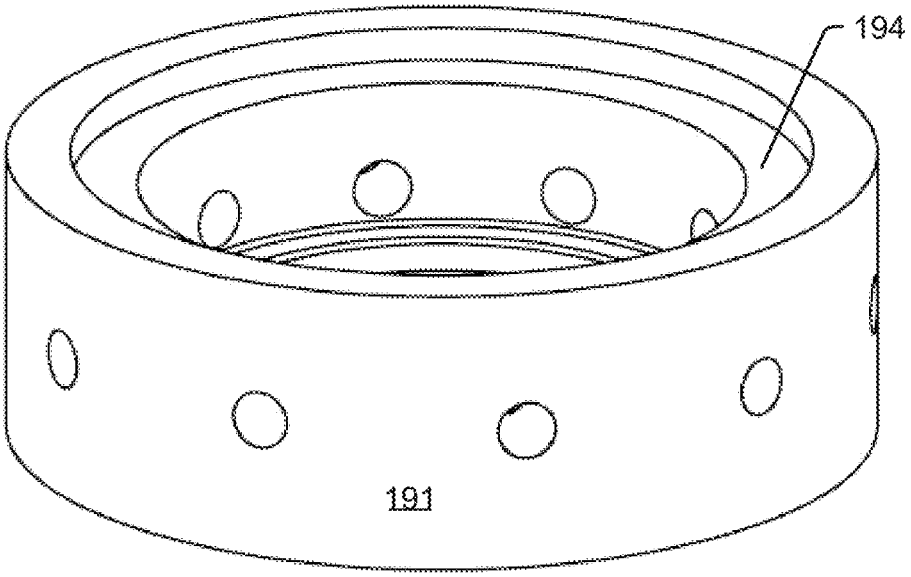

Fig. 37
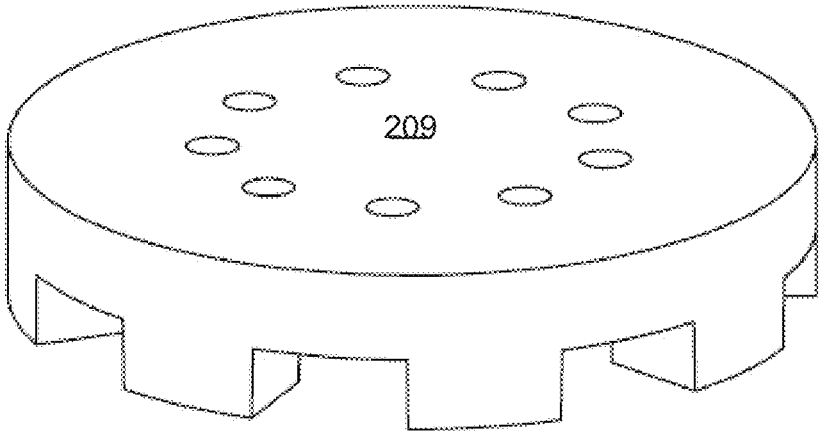
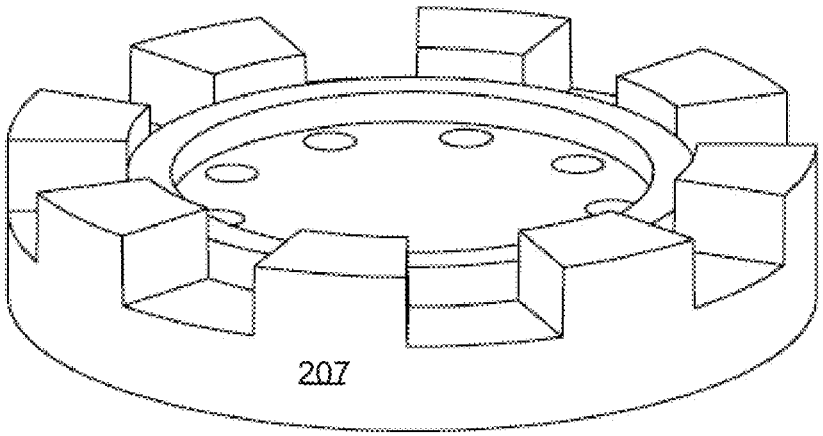

(Area C)

MOLDED HOCKEY PUCK WITH ELECTRONIC SIGNAL TRANSMITTER CORE

CROSS REFERENCE TO RELATED APPLICATIONS

This application is related to and claims priority from the following U.S. patents and patent applications. This application is a continuation of U.S. application Ser. No. 16/503,061, filed Jul. 3, 2019, which is a continuation of U.S. application Ser. No. 16/027,594, filed Jul. 5, 2018, which is a continuation of U.S. application Ser. No. 15/260,122, now U.S. Pat. No. 10,016,669, filed Sep. 8, 2016, each of which is incorporated herein by reference in its entirety.

BACKGROUND OF THE INVENTION

Despite the current popularity of hockey, television viewing is hampered by the poor visibility of the hockey puck as it moves around the ice at high speeds. In order to be able to view all areas of the ice rink, cameras must be located far from the ice rink. Thus, a standard hockey puck tends to appear as a small dot on the screen. As a result, it is difficult to follow the puck as it is passed from player to player, and it is especially difficult to follow the puck as it is shot toward the goal and either deflected, caught or missed by the goalie. Often, viewers recognize a score only when a signal light is lit or the announcer informs the viewer that a goal has been scored.

U.S. Pat. No. 5,564,698 discloses a hockey puck including electromagnetic transmitters. The transmitters transmit a signal, for example an IR signal, which is captured in one or more sensors around the ice rink. The sensors are able to locate the instantaneous position of the hockey puck, which permits enhancement of the image of the puck on a television monitor. It is important that the transmitters within the puck not affect the overall dimensions of the puck, or the performance of the puck, such as its feel when struck and its reaction when received on a stick or bouncing off a surface.

SUMMARY OF THE INVENTION

Embodiments of the present technology relate to a hockey puck including an internal transmitter enabling instantaneous identification of its position as it moves around. In embodiments, the puck is comprised of two molded subcomponents, which encapsulate a signal transmitter and are sealed together to form the hockey puck. The signal transmitter may include driver electronics and a number of signal transmitters which together generate and emit an electromagnetic signal. In one embodiment, the electromagnetic signal may be infrared (IR) light emitted by a plurality of diodes mounted in openings in the subcomponents, for example around an outer circumference of the hockey puck and through a top and bottom surfaces of the hockey puck. In still further embodiments, the puck may be formed of a material that allows electromagnetic radiation to be emitted through the subcomponents, and the diode cavities may be omitted.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 13 a top view of a hockey puck according to embodiments of the present invention.

FIG. 14 is a cross-sectional view through line 14-14 of FIG. 13.

FIG. 15 is a cross-sectional view through line 15-15 of FIG. 13.

FIG. 16 is a top view of a bottom subcomponent according to the third embodiment.

FIG. 17 is a cross-sectional view through line 17-17 of FIG. 16.

FIG. 18 is a cross-sectional view through line 18-18 of FIG. 16.

FIG. 22 illustrates an alternative configuration of subcomponents of a hockey puck according to a further embodiment of the present invention.

FIG. 28 illustrates an alternative configuration of subcomponents of a hockey puck according to a further embodiment of the present invention.

FIG. 37 illustrates an alternative configuration of subcomponents of a hockey puck according to a further embodiment of the present invention.

DETAILED DESCRIPTION

Figure 1:
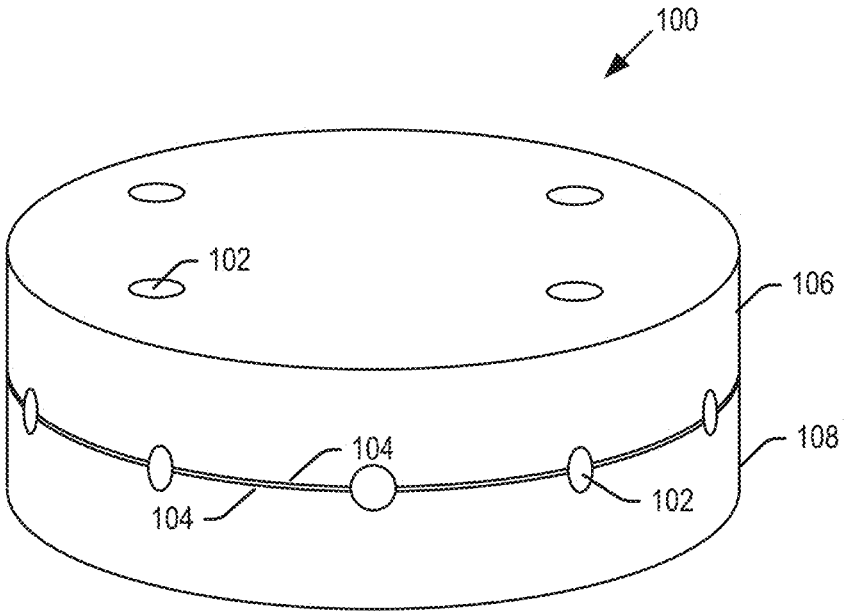
FIG. 1 is a perspective view of a hockey puck according to embodiments of the present invention.

Embodiments of the present technology will now be described with reference to the figures, which in general relate to a hockey puck including an internal signal transmitter enabling instantaneous identification of the puck position as it moves around an ice rink. In embodiments, the puck is comprised of two molded subcomponents, which encapsulate a signal transmitter and fit together to form the hockey puck. The two molded subcomponents may be formed of vulcanized rubber, and may include various features for supporting the signal transmitter and for ensuring a tight and secure fit when the subcomponents are joined together. In embodiments, the subcomponents may be formed of top and bottom halves, or an outer ring surrounding an inner plug.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal," or variations thereof, as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

The signal transmitter may include a printed circuit board with driver electronics, power source and a number of signal transmitters which together generate and emit an electromagnetic signal. In one embodiment, the electromagnetic signal may be infrared (IR) light emitted by a plurality of diodes around an outer circumference of the hockey puck and through top and bottom surfaces of the hockey puck. Other wavelengths of electromagnetic energy may be used in further embodiments. In embodiments, the printed circuit board and diodes may be encased within a capsule, but the capsule may be omitted in further embodiments.

In embodiments using diodes, the subcomponents may be formed with openings around the outer circumference and top and bottom surfaces for receiving the diodes. The openings allow ends of the diodes to extend to the outer surface of the puck to enable signal emission from the puck. In embodiments where the diodes are encased within a capsule recessed within the puck, signals from the diodes may be communicated from the diodes to the outer surface of the puck by light pipes provided in the openings in the subcomponents. In still further embodiments, the puck may be formed of a material that allows electromagnetic radiation to be emitted through the subcomponents, and the diode openings may be omitted.

The physical characteristics of the puck of the present technology may be the same as a conventional puck without a signal transmitter. Thus, the composition of the subcomponents may be customized for each embodiment of the signal transmitter. The physical characteristics may for example include the look, feel, size and weight of the puck. The physical characteristics may further include the performance of the puck, such as its feel and reaction when caught, struck or passed, and its reaction when bouncing off a surface.

FIG. 1 illustrates a perspective view of an exterior of a hockey puck 100 according to embodiments of the present technology. With the exception of holes 102 for the emission of an electromagnetic signal, and an embossed seam 104 (both of which are explained below), the exterior appearance and physical characteristics of puck 100 may match that of a conventional hockey puck, such as for example those used in the U.S. National Hockey League. Puck 100 may have a cylindrical shape, with a 1 inch thickness and a 3 inch circular diameter. Although not shown in FIG. 1, the outer circumference of puck 100 may include a dimple pattern as in a conventional hockey puck to increase friction between the puck 100 and a hockey stick handling, passing and shooting the puck.

As explained below, puck 100 may house a signal transmitter. As such, subcomponents of the puck 100 may be molded, and then assembled together with the signal transmitter encased within an interior of the puck 100. In the embodiment shown in FIG. 1, subcomponents 106 and 108 comprise upper and lower cylindrical halves which may be affixed together around the signal transmitter, for example in a glue process explained below. Each of the subcomponents 106, 108 may be formed of vulcanized rubber and, in one embodiment, may be fabricated by Soucy Baron Inc., having an office in Saint-Jerome, Canada. The subcomponents 106, 108 may be formed of other materials and fabricated by other companies in further embodiments. The subcomponents 106, 108 may include the same materials as those used in the fabrication of a conventional hockey puck (natural rubber, oils, minerals and carbon black).

However, as explained below, the ratios of the various materials may be adjusted relative to those used in a conventional hockey puck to provide the same performance as a conventional hockey puck despite the hollow core and signal transmitter encased therein. In addition to or instead of varying the ratio of the puck materials, the cure time and/or temperature at which the subcomponents 106, 108 are formed may vary relative to that of a conventional hockey puck to provide the same performance as a conventional hockey puck.

Figure 2:
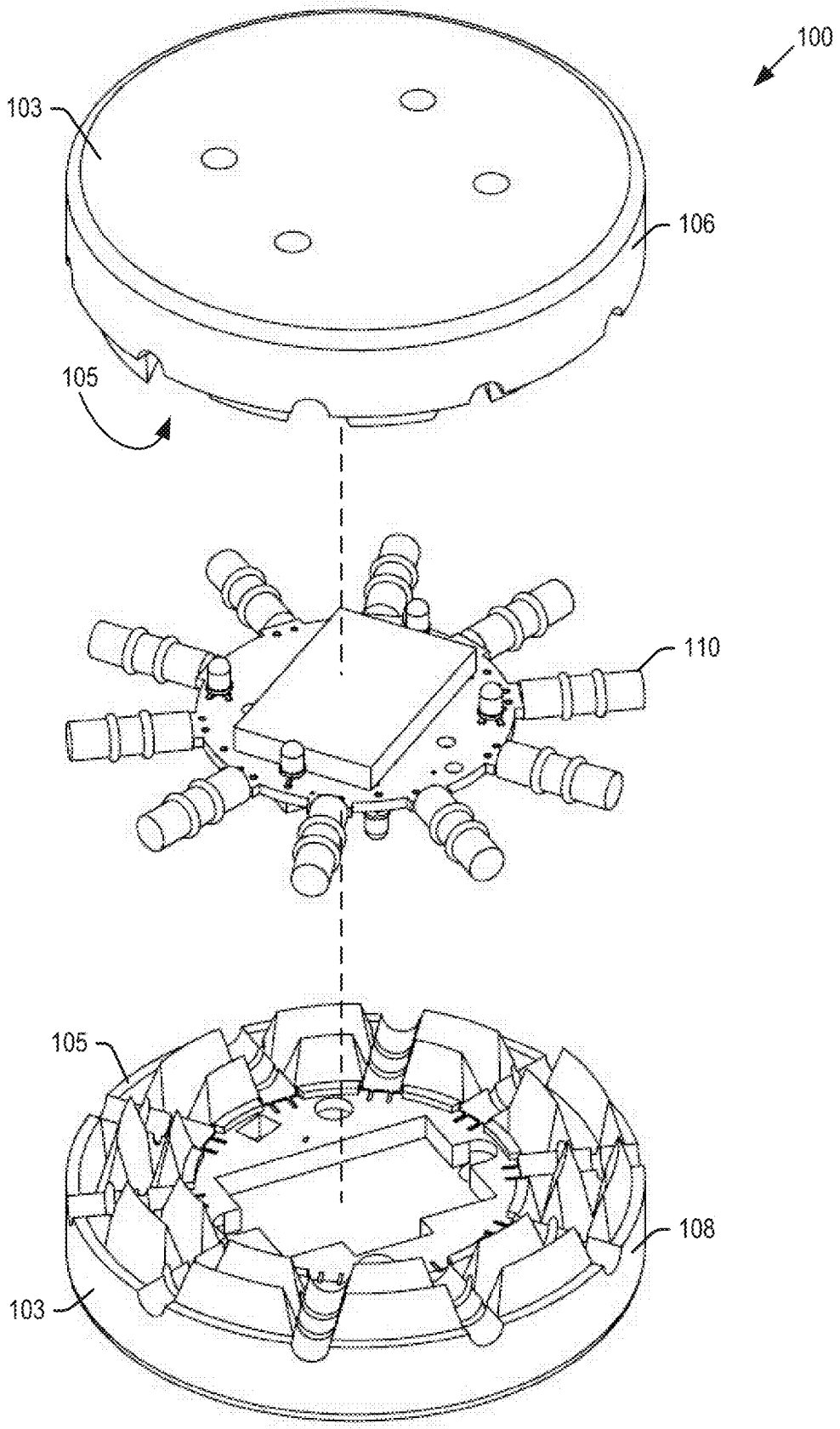
FIG. 2 is an exploded perspective view of a first embodiment of a hockey puck according to the present invention.

FIG. 2 shows an exploded perspective view of a first embodiment of a hockey puck 100. The hockey puck 100 of this embodiment may include top and bottom subcomponents 106 and 108, respectively, and a signal transmitter 110 housed therebetween. Each of the subcomponents 106, 108 includes an exterior surface 103 visible when the subcomponents are sealed together to form the finished hockey puck, and an interior surface 105 that is not visible after the subcomponents are sealed together.

The signal transmitter 110 emits electromagnetic radiation from the different surfaces of the puck 100, which radiation is detected by sensors around the ice rink regardless of the orientation of the puck 100. The sensors are able to locate the instantaneous position of the hockey puck, which permits enhancement of the image of the puck on a television monitor. For example, the puck may be highlighted in different colors, or different-colored contrails may be shown behind the puck, as it is shot, passed, leaves the ice surface or enters the goal.

Details of the electronics and components of signal transmitter 110 are disclosed for example in U.S. Pat. No. 5,564,698, entitled "Electromagnetic Transmitting Hockey Puck." However, referring now to the perspective view of FIG. 3, signal transmitter 110 may generally include a printed circuit board (PCB) 114 having driver electronics formed on top and bottom surfaces of the PCB 114. The signal transmitter 110 may further include a power source 112 such as a rechargeable battery.

In embodiments, the signal transmitter 110 may further include a number of diodes 120 (some of which are numbered in FIG. 3) which generate and emit electromagnetic radiation under the control of the driver electronics on PCB 114. The diodes 120 may emit electromagnetic radiation outside of the visible light spectrum, such as for example IR light. It is conceivable that diodes 120 emit light in the visible spectrum in further embodiments.

In the embodiment shown, there are a total of eighteen diodes 120: four axially extending diodes 120*a* on a top surface of PCB 114 (to emit a signal from a top surface of the puck), four axially extending diodes 120*b* on a bottom surface of PCB 114 (to emit a signal from a bottom surface of the puck), and ten radially extending diodes 120*c* extending radially from the outer circumference of the PCB 114 (to emit the signal from an outer circumference of the puck). Thus, radiation from the puck may be detected regardless of an orientation of the puck. It is understood that the signal transmitter 110 may include more or less diodes 120 in further embodiments, and diodes in other places than shown. When the puck 100 is fully assembled, outer ends of the diodes 120 (i.e., most distal from the PCB 114) may lie flush with the exterior surfaces 103 of the subcomponents 106, 108.

Figure 3:
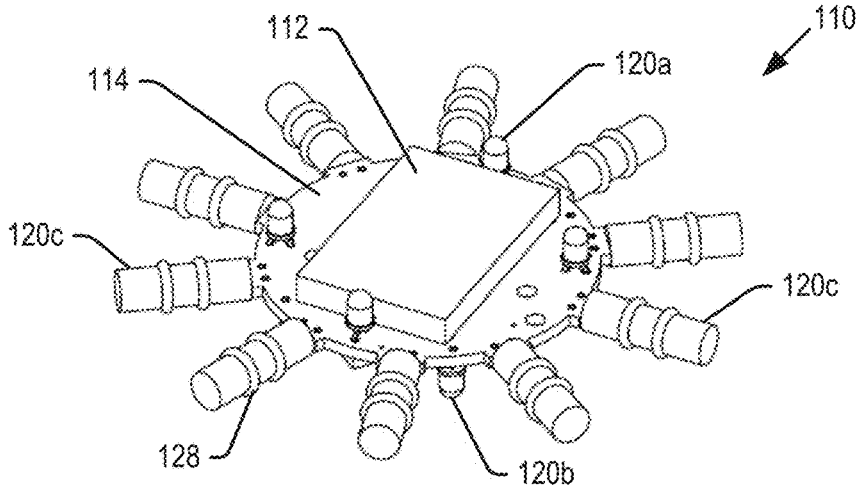
FIG. 3 is a perspective view of an embodiment of a signal transmitter according to the present invention.
Figure 4:
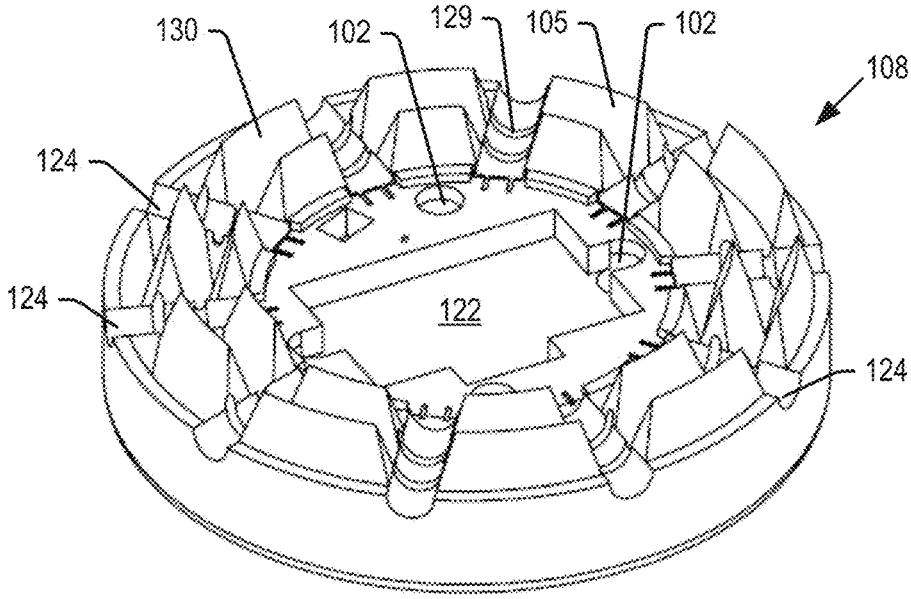
FIG. 4 is a perspective view of an embodiment of a subcomponent of a hockey puck according to the present invention.

As opposed to embodiments described hereinafter, the signal transmitter 110 in the embodiment of FIGS. 2 and 3 is unencapsulated, and interior surfaces 105 of the subcomponents 106, 108 are keyed with features to directly support a battery 112, the printed circuit board 114 and the diodes 120 of the signal transmitter 110. FIG. 4 illustrates interior surfaces 105 of the bottom subcomponent 108 for receiving and supporting the signal transmitter 110. It is understood that the top subcomponent 106 may include similar features for receiving and supporting the signal transmitter 110.

As seen in FIG. 4, the interior surface 105 of subcomponent 108 may include a cavity 122 sized and shaped to receive the battery 112 on a bottom surface of the PCB 114. The interior surface of subcomponent 108 further includes holes 102 (two of which are numbered) for receiving the axially extending diodes 120*b* on a bottom surface of the PCB 114. The interior surface of subcomponent 108 may further include semicircular channels 124 (some of which are numbered) for receiving the radially extending diodes 120*c* around an outer circumference of the PCB 114. The interior surface of subcomponent 106 may have a corresponding set of semicircular channels 124, so that the semicircular channels in the subcomponents 106, 108 together form radiantly extending holes enclosing the diodes 120*c*.

As seen in FIG. 3, the radially extending diodes 120*c* may include ridges 128 (one of which is numbered). These ridges mate within the detents 129 (again, one of which is numbered) in the channels 124 of subcomponent 106, 108. The mating of the ridges 128 within detents 129 provides resistance to the shear forces which are generated when the subcomponents 106, 108 are glued together as explained below. The ridges 128 and detents 129 may be omitted in further embodiments.

The cavities 122, holes 102, channels 124 and other indentations on the interior surfaces 105 of subcomponents 106, 108 allow the subcomponents 106, 108 to fit tightly together with the signal transmitter 110 enclosed snuggly therebetween. With the exception of holes 102 and channels 124, no other indentations formed on the interior surfaces of subcomponents 106, 108 are open to an exterior of the puck 100.

Figure 5:
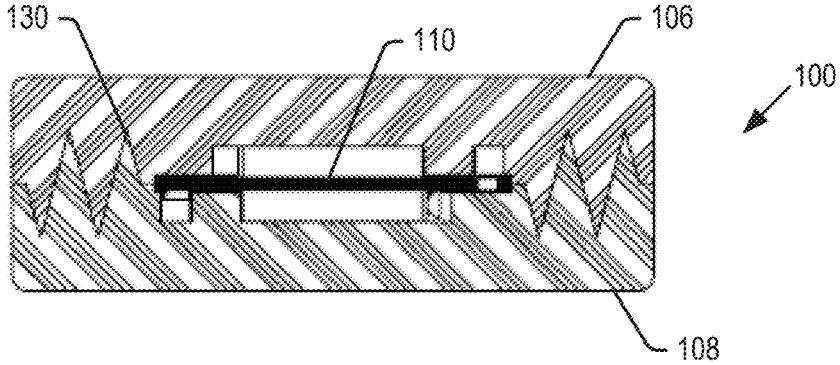
FIG. 5 is a cross-sectional view of a hockey puck according to the first embodiment.

The interior surfaces 105 of subcomponents 106, 108 further include keyed features 130 for ensuring a tight and secure fit of the subcomponents when they are glued to each other. The keyed features 130 may be in a variety of different configurations, some of which are shown in the drawings. In FIGS. 4 and 5, the keyed features 130 include a plurality of wedges arranged in concentric circles. As shown in the cross-section view of FIG. 5, the concentric wedges in the subcomponent 108 are offset from, and complementary to, the concentric wedges in the subcomponent 106. In particular, the peaks of the wedges in subcomponent 108 align with the valleys of the wedges in subcomponent 106, and vice-versa. Thus, when assembled together as shown in the cross-sectional view of FIG. 5, the features 130 on the interior surface 105 of subcomponent 108 mate snugly with the features 130 on the interior surface 105 of subcomponent 106.

The features 130 may have various characteristics. First, the features provide a relatively large surface area for receiving glue as explained below to securely affix the subcomponents 106 and 108 to each other. Second, in embodiments, the features 130 may be sandblasted, or formed within a mold that is sandblasted. The features/mold may alternatively be chemically etched. Sandblasting/chemical etching increases the surface area and provides nooks and crannies for the glue between adjacent surfaces of the features 130 of subcomponents 106, 108. Sandblasting may be omitted in further embodiments. Third, extending vertically, the features 130 are able to exert lateral forces against each other (for example parallel to the top and bottom surfaces of the puck 100) to provide a resistance to shear forces when the subcomponents are affixed together and thereafter.

Figure 6:
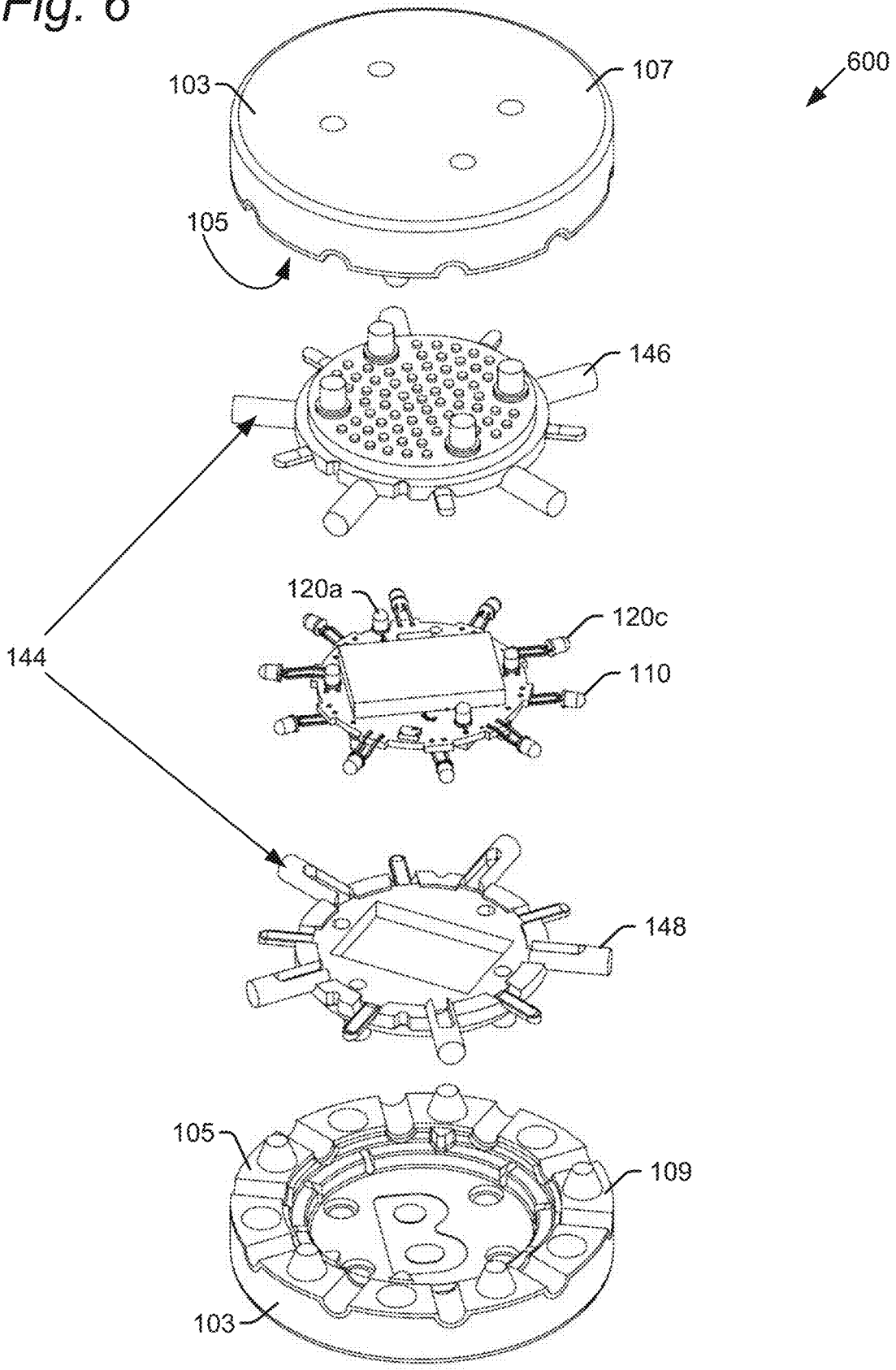
FIG. 6 is an exploded perspective view of a second embodiment of a hockey puck according to the present invention.
Figure 8:
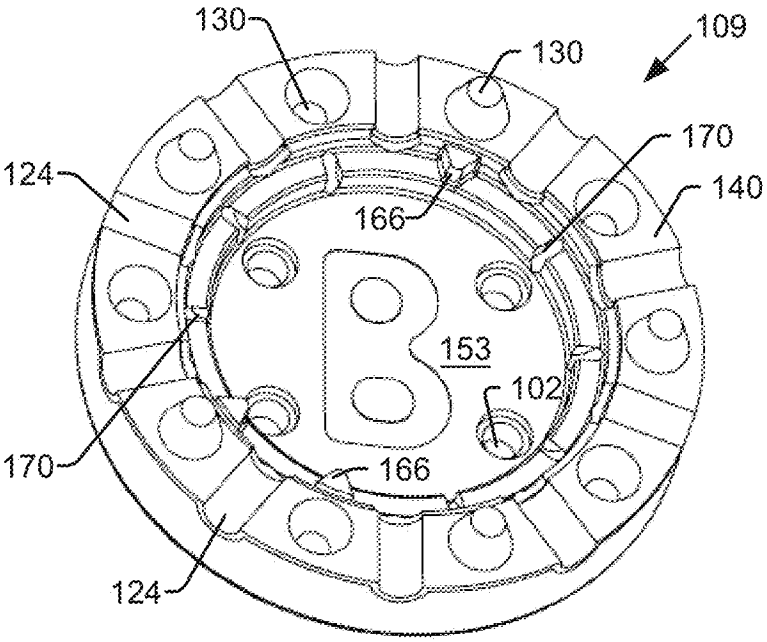
FIG. 8 is a bottom perspective view of one embodiment of subcomponents according to the present invention.
Figure 7:
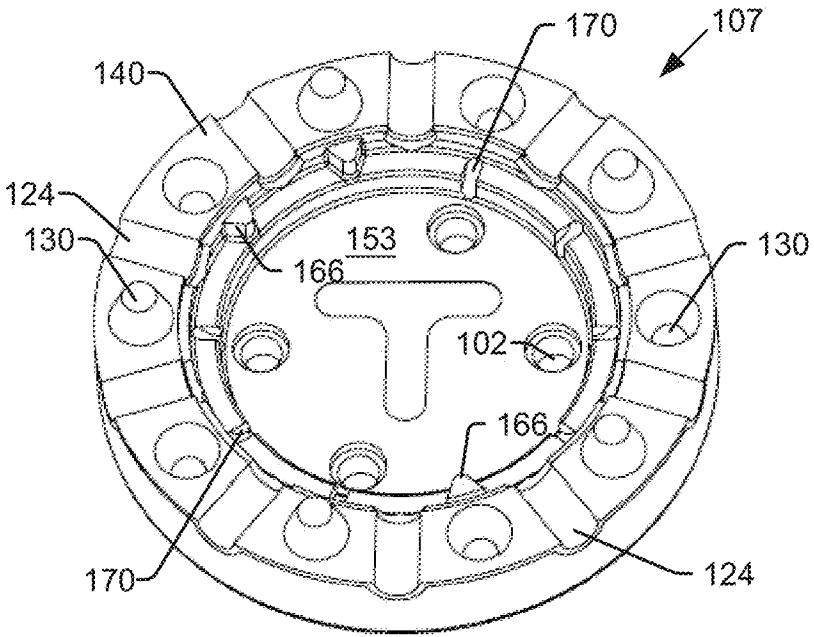
FIG. 7 is a top perspective view of one embodiment of subcomponents according to the present invention.

FIG. 6 shows an exploded perspective view of a puck 600 including an alternative design of the subcomponents 107, 109 and an alternative design of the signal transmitter 110. FIGS. 7 and 8 show perspective views of the interior surfaces 105 of the subcomponents 107, 109 according to the embodiment of FIG. 6. As shown, each subcomponent 107, 109 includes an outer ring 140 having features 130 (some of which are numbered). In this embodiment, the features 130 in each ring 140 may comprise a number of positively extending truncated cones and a number of negatively recessed truncated cones. Full cones may be used instead of truncated cones in further embodiments. Additionally, complementary positively extending and negatively recessed shapes other than cones may be used in further embodiments.

The cones are arranged on the respective rings 140 such that, when the subcomponents 107, 109 are mated together, a positively extending cone mates within a negatively recessed cone in the opposite subcomponent. In the embodiments of FIGS. 7 and 8, each subcomponent includes both positively extending and negatively recessed cones, which mate within their compliment in the opposite subcomponent. In further embodiments, the ring 140 on subcomponent 107 may be all positively extending cones or negatively recessed cones, and the ring 140 on subcomponent 109 may include all of the opposite shape. Thus, the positively extending cones mate within the negatively recessed cones when the subcomponents 107, 109 are mated together. The features 130 on the rings 140 in the embodiment of FIGS. 7 and 8 may include the characteristics described above with respect to the features shown in FIG. 4.

Referring again to the exploded perspective view of FIG. 6, this embodiment may include a signal transmitter 110 that may be encased within a capsule 144 comprised of sub-capsule halves 146 and 148. Sub-capsule halves 146, 148 may for example be formed of molded silicone (or other encapsulant) and may completely enclose the signal transmitter 110 when the halves 146, 148 are assembled together.

Figure 9:
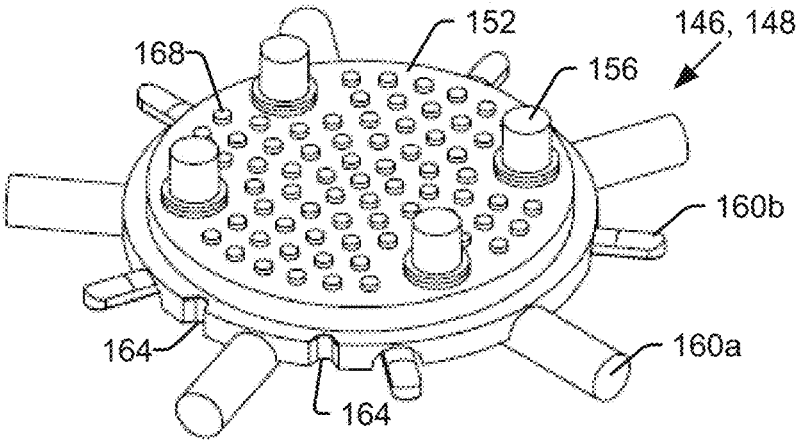
FIG. 9 is a perspective of a section of a capsule for encapsulating the signal transmitter according to one embodiment of the present invention.
Figure 10:
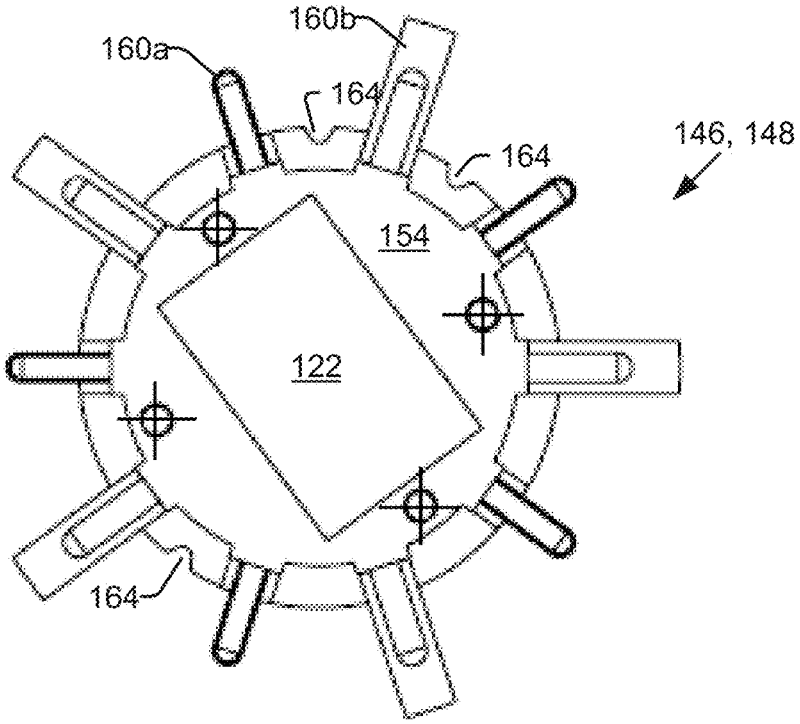
FIG. 10 is a top view of a section of a capsule for encapsulating the signal transmitter according to one embodiment of the present invention.

FIGS. 9 and 10 illustrate a perspective view of an exterior surface 152 and a top view of an interior surface 154 of sub-capsule halves 146, 148. The halves 146, 148 may be identical to each other, with the exception that components in the half 146 may be rotated off axis with respect to the corresponding components in the half 148, as explained below.

Figure 11:
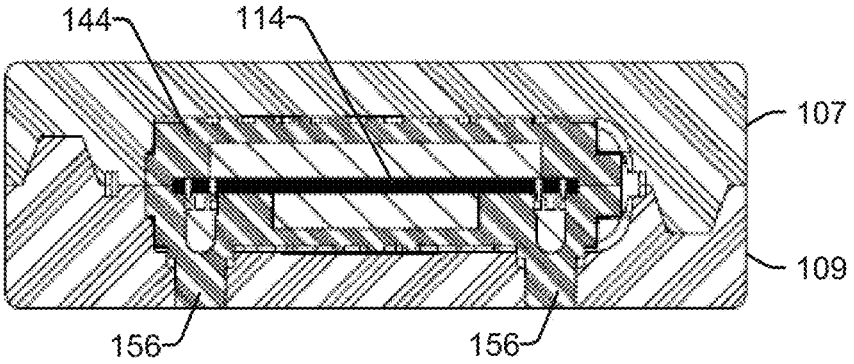
FIG. 11 is a cross-sectional view of a hockey puck according to the second embodiment.

The capsule 144 includes light pipes 156 and 160 for receiving diodes 120 and for communicating the electromagnetic radiation from diodes 120 to the exterior surface 103 of the hockey puck 100. Each sub-capsule half 146, 148 includes axially extending light pipes 156 (FIGS. 9 and 11) extending from exterior surface 152. These axially extending light pipes in respective halves 146, 148 receive the axially extending diodes 120*a*, 120*b* extending from the top and bottom surfaces, respectively, of the PCB 114. The light pipes 156 in turn fit through holes 102 in the subcomponents 107, 109 to be flush with the exterior surface 103 of the subcomponents 107, 109.

The capsule 144 may further include radially extending light pipes 160 extending from an outer circumference of capsule 144. The radially extending light pipes 160 in capsule 144 receive the radially extending diodes 120*c* extending from the outer circumference of the PCB 114. Each of the radially extending light pipes 160 is formed of two mating pieces, with a first piece formed in sub-capsule half 146 and a second, complementary piece formed in sub-capsule half 148. The two pieces fit together around diodes 120*c* when the sub-capsule halves 146, 148 are brought together. The light pipes 160 in turn fit within channels 124 in the subcomponents 107, 109 to be flush with the exterior surface 103 of the subcomponents 107, 109.

The first and second pieces in respective halves may have the same configuration, each forming one-half of the light pipe 160. However, in other embodiments, the pieces may be dissimilar. For example, in FIGS. 9 and 10, one piece (160*a*) is larger than the complementary piece (160*b*) in the other sub-capsule half. In the embodiment shown in FIGS. 9 and 10, the radially extending diodes 120*c* may fit within the piece 160*a* and the piece 160*b* may act as a cover to encase the diodes 120*c*. In embodiments where the pieces are dissimilar, a sub-capsule half 146, 148 may have both larger pieces 160*a* and smaller pieces 160*b*, and the other sub-capsule half may have the complementary smaller pieces 160*b* and larger pieces 160*a*. Alternatively, one sub-capsule half may have all of one type of piece (for example 160*a*) and the other sub-capsule half may have all of the other type of piece (for example 160*b*).

The sub-capsule halves may each have a cavity 122 for receiving the battery 112 as described above. The subcomponents 107, 109 may each include a recess 153 (FIGS. 7 and 8). The recesses 153 define a central void within the interior of the puck 600 when the subcomponents 107, 109 are brought together. The central void defined by recesses 153 is sized and shaped to snugly receive the capsule 144.

The capsule 144 includes notches 164 as shown for example in FIGS. 9 and 10. The notches 164 are positioned so that there is a single rotational orientation, and a single side facing upward, where the notches 164 align with and fit over raised key-points 166 in the subcomponents 107, 109 (FIGS. 7 and 8). Proper alignment of the raised key-points 166 in the notches 164 ensures the capsule 144 is properly seated between the subcomponents in the proper orientation and with the proper side of the capsule facing upward. In particular, there are two key-points on one side of the subcomponents, and one on the opposite side, which together form a triangle that is not an equilateral triangle. Thus, the key-points define a unique orientation and one side facing upward where the notches 164 in the capsule 144 fit over the key-points.

Exterior surfaces of the sub-capsule halves 146, 148 may include dimples 168 (FIG. 9) which increase the surface area for receiving glue, and provide shear resistance against lateral movement of the capsule 144 in the subcomponents 107, 109 during the gluing process. As seen in FIGS. 7 and 8, the subcomponents 107, 109 may further include weep holes 170 which provide channels for seepage of the glue out of the cavities 153 when the subcomponents are affixed together as explained below.

Figure 12:
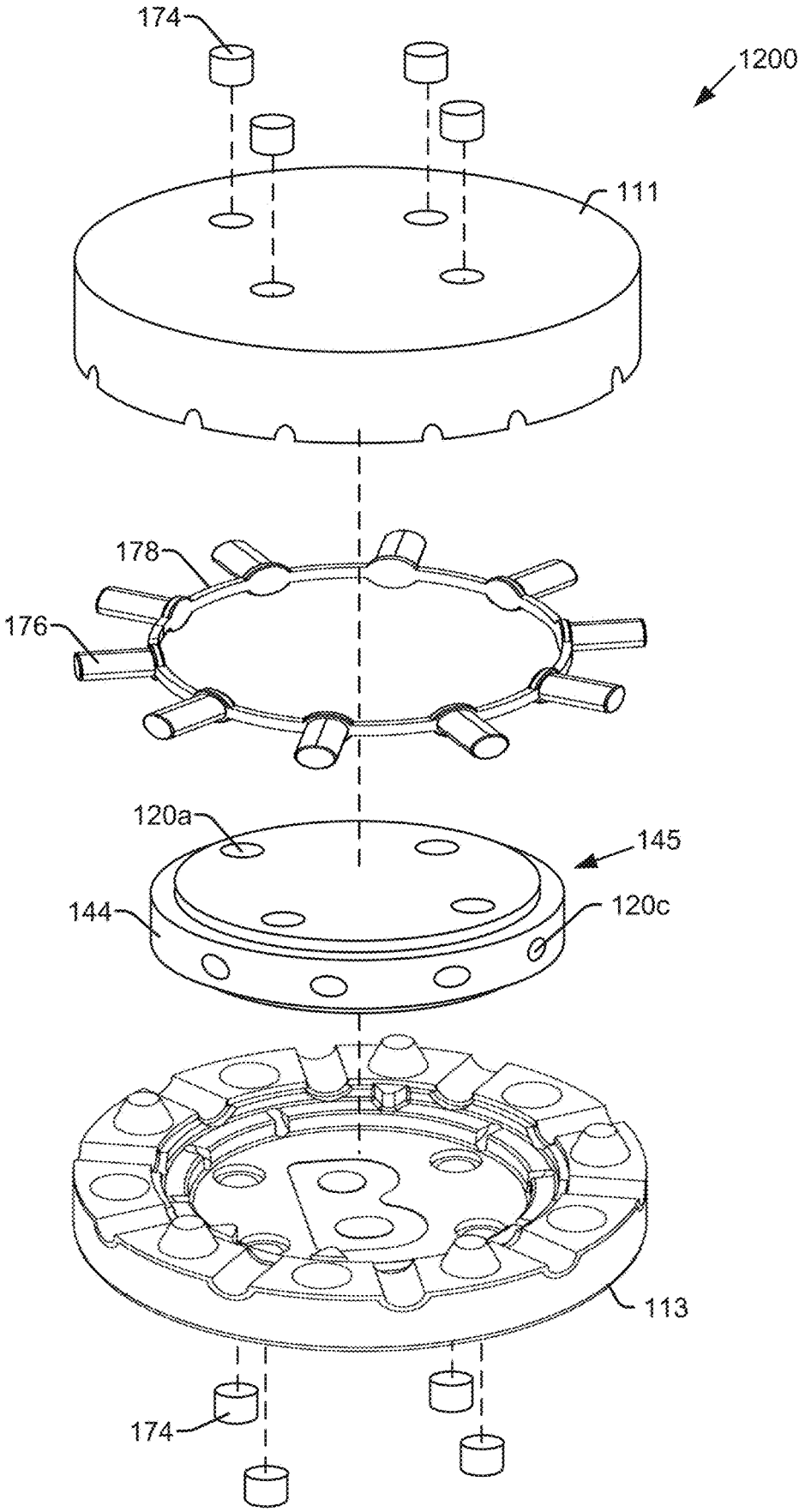
FIG. 12 is an exploded perspective view of a third embodiment of a hockey puck according to the present invention.

FIGS. 12-18 illustrate a further embodiment of the hockey puck according to the present technology. FIG. 12 illustrates an exploded perspective view which is similar to the embodiment shown in FIG. 6, with one difference being that the capsule 144 is preassembled prior to placing the capsule 144 between the subcomponents 111, 113. The capsule 144 shown in FIG. 12 may be identical to the capsule 144 shown in FIG. 6. However, instead of having two separate sub-capsule halves encasing the signal transmitter 145, the signal transmitter 145 including the PCB 114 and diodes 120 may be put in a mold and encased in a single-piece capsule 144 of silicone (or other encapsulant). Thus, the capsule 144 and signal transmitter 145 may be a single integrated unit when assembled between the subcomponents 111, 113.

In order to communicate the electromagnetic radiation from the diodes 120 within the capsule 144, the embodiment of FIG. 12 may further include light pipes 174 and 176. In the embodiment of FIG. 6, the light pipes 156, 160 were integrally formed on the capsule 144. In the embodiment of FIG. 12, the light pipes 174, 176 may be silicone (or other like material) that are molded separately from the capsule 144.

Further details of the puck 1200 of the embodiment of FIG. 12 are shown in the top and cross-sectional views of FIGS. 13-15. FIGS. 14 and 15 are cross-sectional views of the hockey puck 1200, through lines 14-14 and 15-15, respectively, in FIG. 13. The axial light pipes 174 may be plugs that fit within holes 102 in the subcomponents 111, 113. As shown for example in FIGS. 12 and 15, axial light pipes 174 may have a length so that a first end of a light pipe 174 lies against the capsule 144 (over an encased diode 120*a*, 120*b*) and a second, opposite end lies flush with the exterior surface 103 of the subcomponents 111, 113.

As seen for example in FIGS. 12 and 14, the radial light pipes 176 may be molded together on a ring 178. The ring 178 may fit snugly over an outer circumference of the capsule 144, with first ends of the radial light pipes 176 aligned with and lying over the encased diodes 120*c*. The radial light pipes 176 may lie in channels 126, and may have a first end against the capsule 144 and a second, opposite end flush with the exterior surface 103 of the subcomponents 111, 113. In this way, the light pipes 174, 176 transmit the electromagnetic radiation from the diodes 120 to the exterior of the puck 1200. The capsule 144 may include notches 164 (not shown in FIGS. 12-18) which receive raised key-points 166 to ensure the capsule is properly oriented, with the correct side facing upward, so that the light pipes 174, 176 align with their respective diodes 120.

Further details of the subcomponents 111, 113 of the embodiment of FIG. 12 are shown in the top and cross-sectional views of FIGS. 16-18. FIGS. 17 and 18 are cross-sectional views through lines 17-17 and 18-18, respectively, in FIG. 16. In general, the subcomponents 111, 113 of the embodiment of FIG. 12 may have the same features as the subcomponents 111, 113 described above the respect to FIG. 6. These features include for example recess 153 with holes 102, and a ring 140 including channels 124 and features 130 in the form of positively extending and negatively recessed truncated cones. The subcomponents 111, 113 may further include weep holes 170. Each of these components may be structurally and operationally similar to the like components described above with respect to the embodiment in FIG. 6.

While the embodiment of FIG. 6 is described and shown with light pipes integrally formed on capsule 144, it is understood that the embodiment of FIG. 6 may have separate light pipes as shown and described above with respect to FIG. 12. In a further example, instead of being formed on a separate ring 178, the light pipes 174 and/or 176 may be integrally formed on the capsule 144 in the embodiment of FIG. 12. Light pipes integrally formed on the capsule may have an advantage that they are able to better withstand the hydrostatic forces generated during the gluing process explained below, so that they do not get pushed out of the holes 102 and channels 124.

Figure 19:
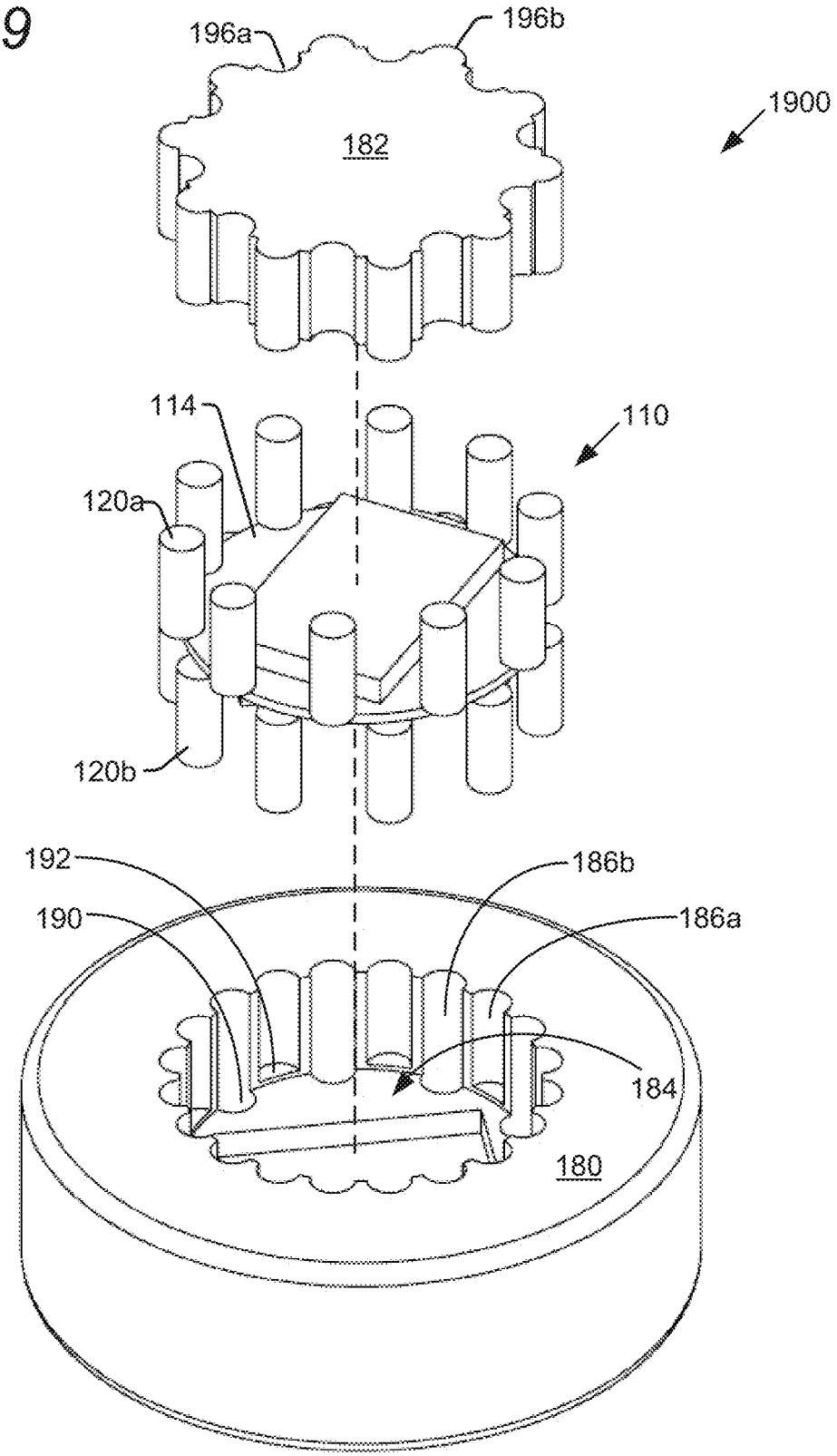
FIG. 19 is an exploded perspective view of a fourth embodiment of a hockey puck according to the present invention.
Figure 20:
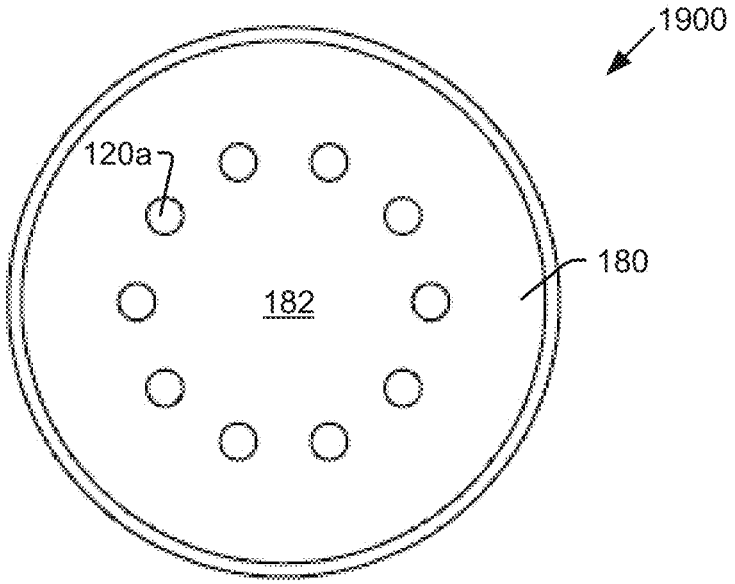
FIG. 20 a top view of a hockey puck according to the fourth embodiment of the present invention.
Figure 21:
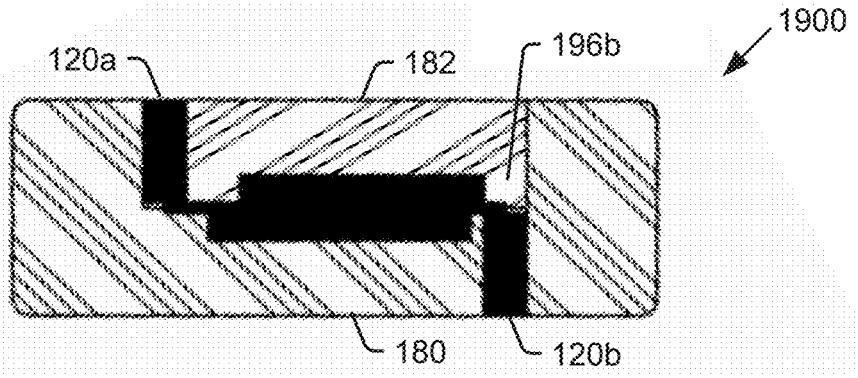
FIG. 21 a cross-sectional view of a hockey puck according to the fourth embodiment of the present invention.
Figure 23:
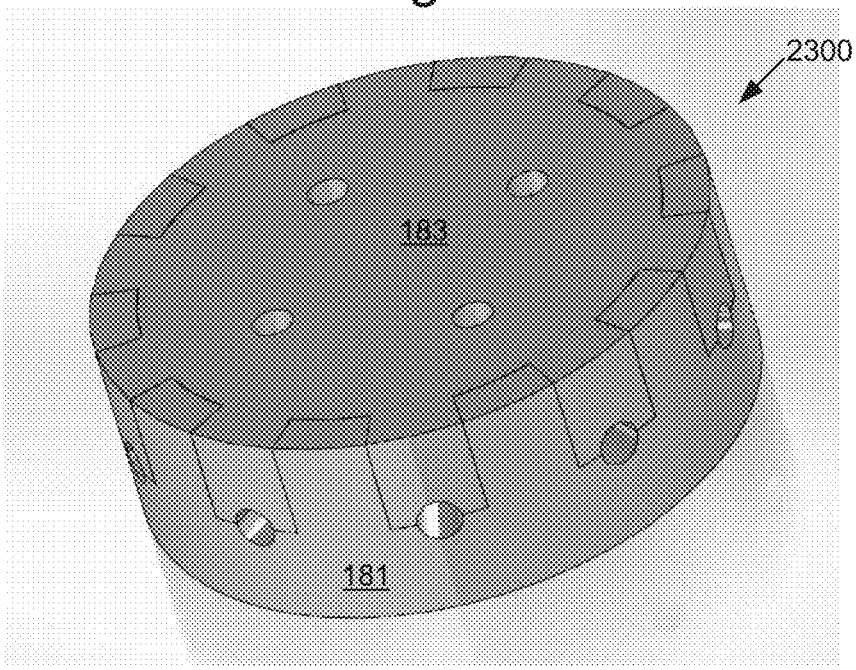
FIG. 23 illustrates an alternative configuration of subcomponents of a hockey puck according to a further embodiment of the present invention.
Figure 24:
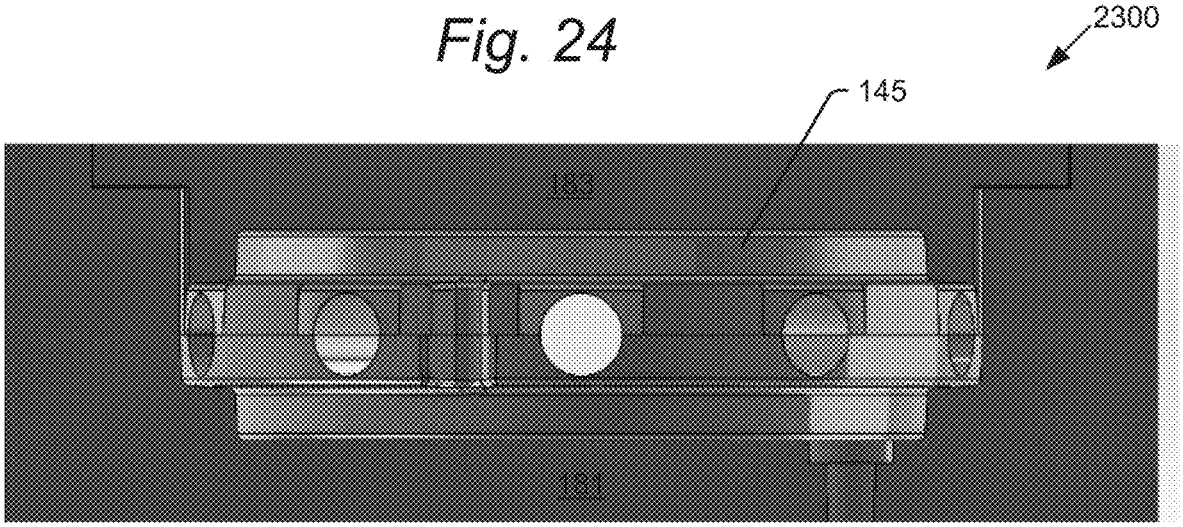
FIG. 24 illustrates an alternative configuration of subcomponents of a hockey puck according to a further embodiment of the present invention.

In embodiments described thus far, subcomponents described are top and bottom halves of the hockey puck. FIGS. 19-21 illustrate a further embodiment of the hockey puck 1900 including a subcomponent 180 comprising the bottom portion of the puck 1900. Subcomponent 180 comprises a larger piece, e.g., a base, and includes the bottom surface of the puck 1900, the rounded circumferential edge of the puck 1900, and a portion of the top surface of the puck 1900. Subcomponent 182 comprises a smaller piece, e.g., a cover, filling in the remainder of the top surface of puck 1900. The edges of the cover and bottom portion of the puck abut with a toothed design. Thus, where the embodiments of FIGS. 1-18 have a lip (embossed seam 104) in the puck 1900 around rounded circumferential edge of the puck 1900, the embodiment of FIGS. 19-21 have a seam on the top planar surface of puck (or on the bottom planar surface where the subcomponents 180, 182 are switched).

In the embodiment of FIGS. 19 and 20, the signal transmitter 110 includes axial diodes 120*a* and 120*b* on top and bottom surfaces, respectively, of PCB 114. The subcomponent 180 includes an opening 184 for receiving signal transmitter 110. Opening 184 may have circumferential edges defined by channels 186*a* and 186*b*. The channels 186*b* receive and mate with the downwardly extending diodes 120*b*. The bottom portion 190 of channels 186*b* is open to the exterior surface of the puck 1900 so that electromagnetic radiation from diodes 120*b* may be omitted from a bottom surface of the puck 1900.

The channels 186*a* receive and mate with the upwardly extending diodes 120*a*. A bottom portion 192 of the channels 186*a* may be sealed. The subcomponent 182, referred to hereinafter as cover 182, includes a number of axial recesses 196*a* and axial protrusions 196*b* around its outer circumference. The recesses 196*a* align with channels 186*a* and, together with the channels 186*a*, enclose the upwardly extending diodes 120*a* along their lengths when cover 182 is sealed within the opening 184. The recesses 196*a* and channels 186*a* are open at an upper surface of the puck 1900 to allow emission of electromagnetic radiation from diodes 120*a* at the upper surface, as shown in the top view of puck 1900 in FIG. 20.

The protrusions 196*b* align with and fill channels 186*b*. As shown in the cross-sectional view of FIG. 21, when the cover 182 is sealed within the opening 184, the protrusions 196*b* axially align over the diodes 120*b* and seal the channels 186*b* above the diodes 120*b*.

FIGS. 22-39 are edge and perspective views of subcomponent configurations according to a variety of alternative embodiments. FIGS. 21-24 illustrate subcomponents 181, 183 which form a seam extending to a top portion of the puck 2300 and around a circumferential edge of the hockey puck 2300.

Figure 25:
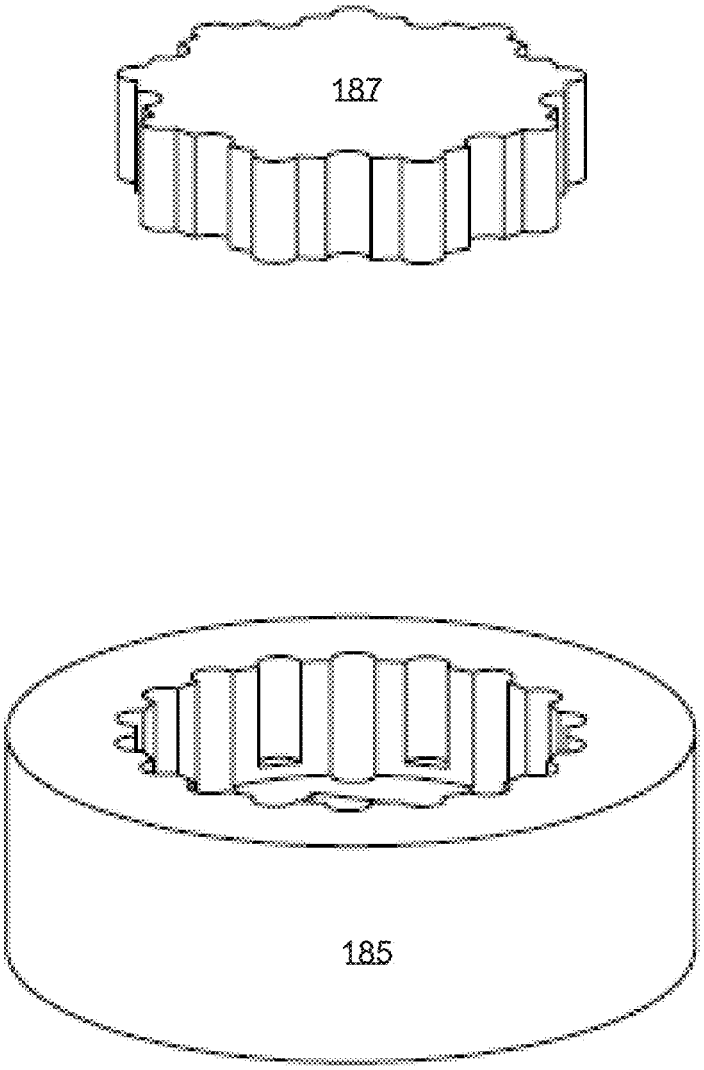
FIG. 25 illustrates an alternative configuration of subcomponents of a hockey puck according to a further embodiment of the present invention.
Figure 26:
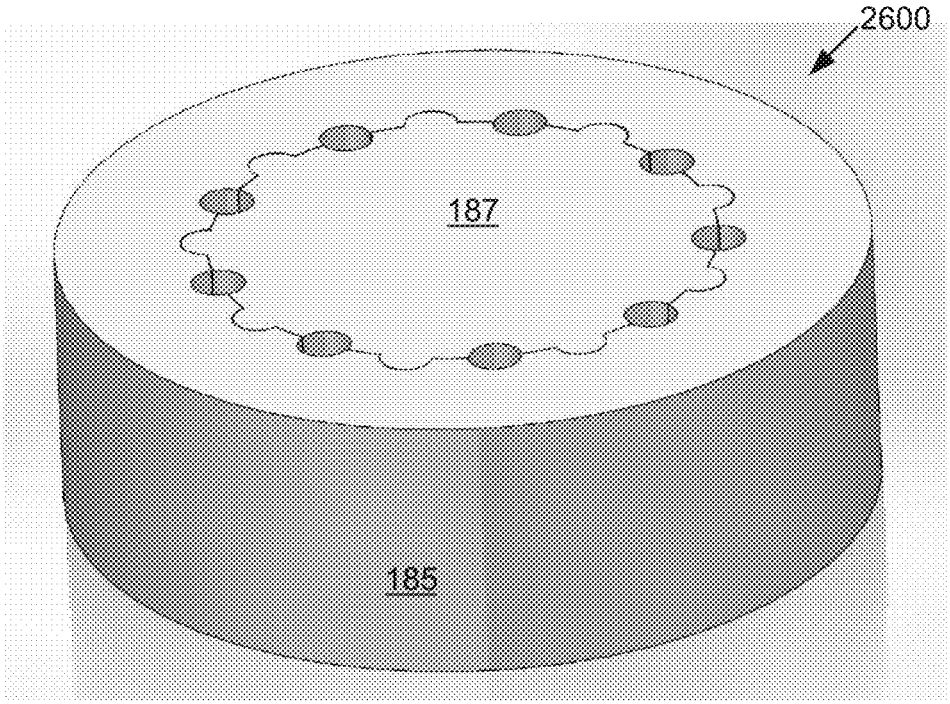
FIG. 26 illustrates an alternative configuration of subcomponents of a hockey puck according to a further embodiment of the present invention.
Figure 27:
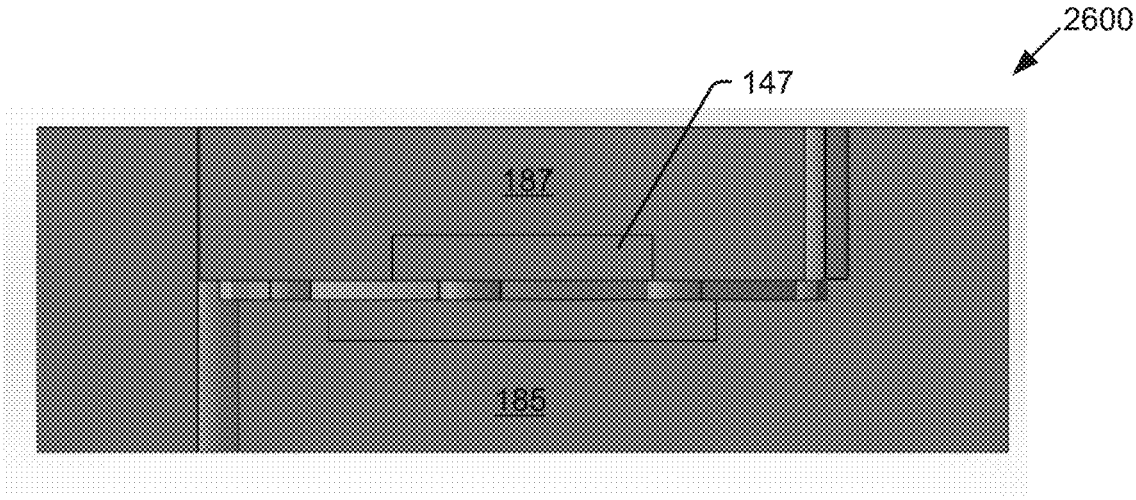
FIG. 27 illustrates an alternative configuration of subcomponents of a hockey puck according to a further embodiment of the present invention.

FIGS. 25-27 illustrate embodiments of subcomponents 185, 187 forming puck 2600 is similar to those described above the respect to FIGS. 19-21, but the spacing of the different sections forming the vertical walls at an interface between subcomponents 185, 187 is slightly different.

Figure 29:
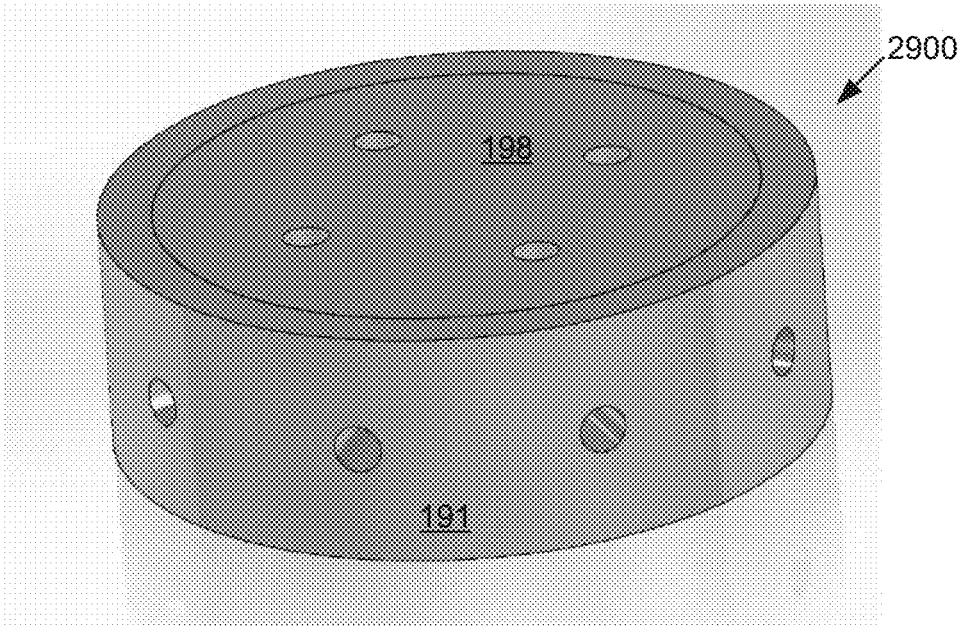
FIG. 29 illustrates an alternative configuration of subcomponents of a hockey puck according to a further embodiment of the present invention.
Figure 30:
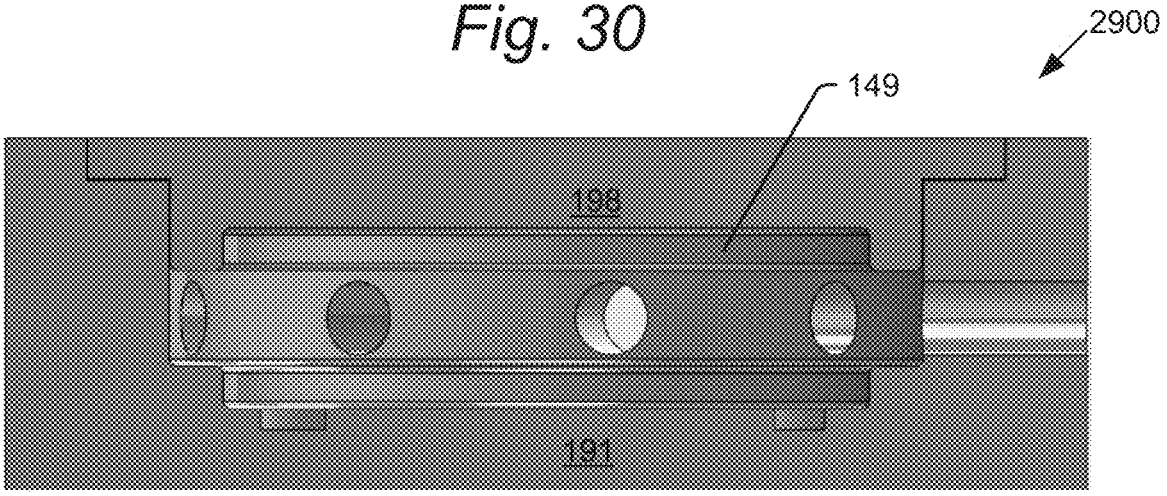
FIG. 30 illustrates an alternative configuration of subcomponents of a hockey puck according to a further embodiment of the present invention.
Figure 31:
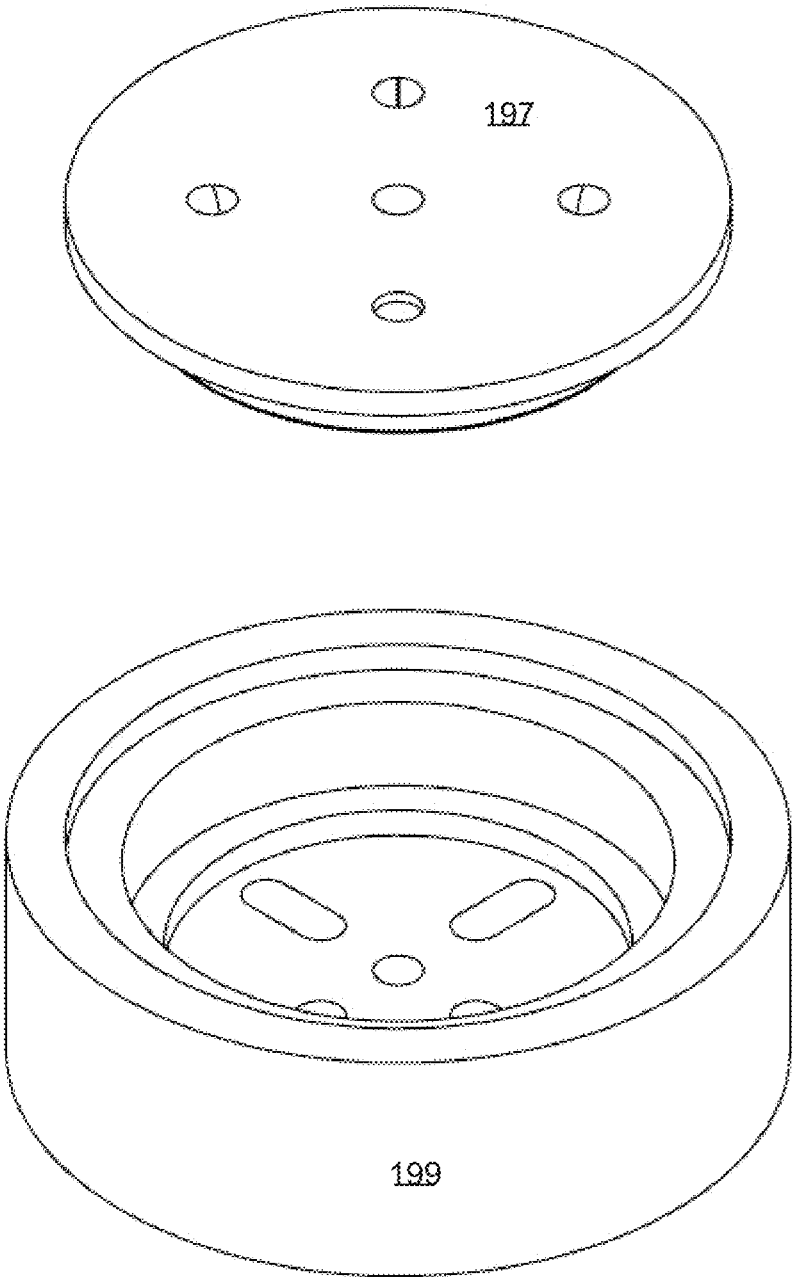
FIG. 31 illustrates an alternative configuration of subcomponents of a hockey puck according to a further embodiment of the present invention.
Figure 32:
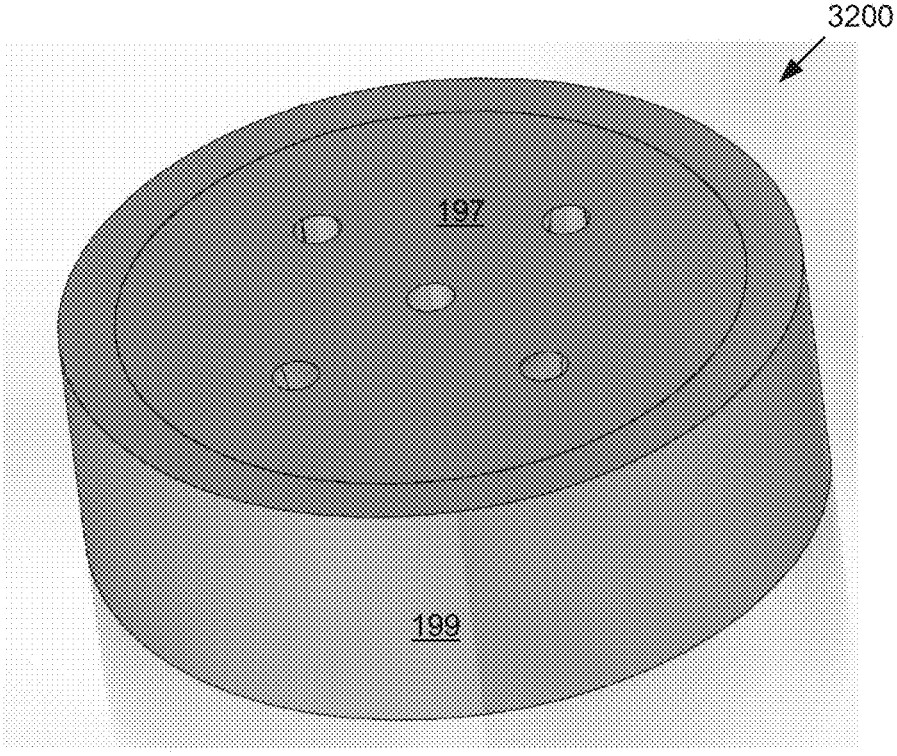
FIG. 32 illustrates an alternative configuration of subcomponents of a hockey puck according to a further embodiment of the present invention.
Figure 33:
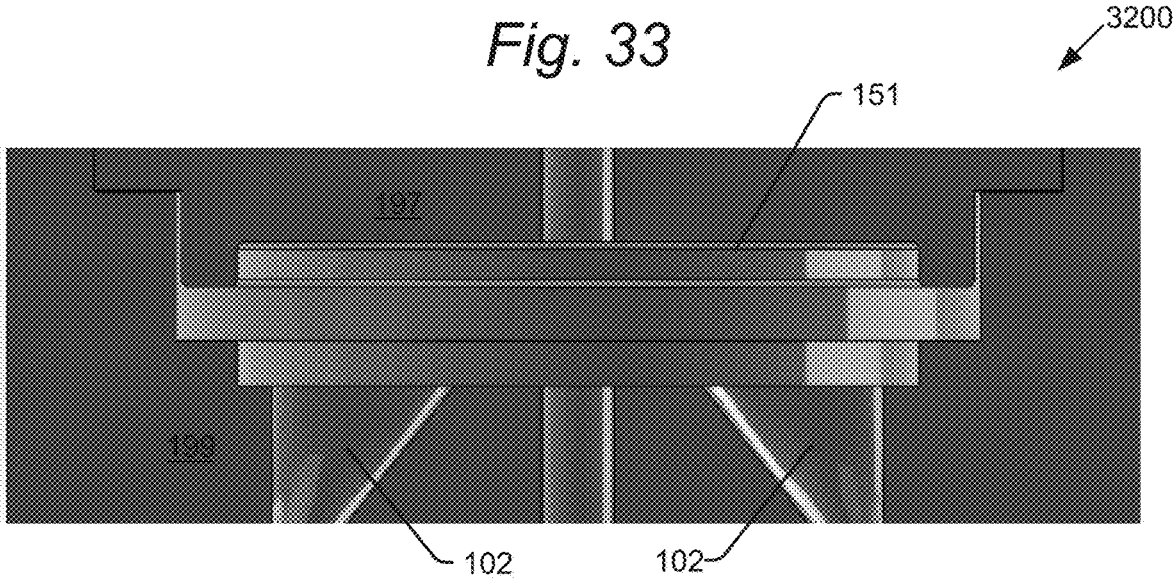
FIG. 33 illustrates an alternative configuration of subcomponents of a hockey puck according to a further embodiment of the present invention.

FIGS. 28-30 illustrate embodiments of subcomponents 191, 198 forming a seam on upper surface of the hockey puck 2900. In this embodiment, the upper subcomponent 198 includes an interior facing flange 193 that seats against a surface 194 in the lower subcomponent 191. The embodiments of the puck 3200 of FIGS. 31-33 are similar to that of FIGS. 28-30, but the lower subcomponent 199 includes elongated holes 102 which taper toward a bottom surface of the subcomponent 199 and away from upper subcomponent 197.

Figure 34:
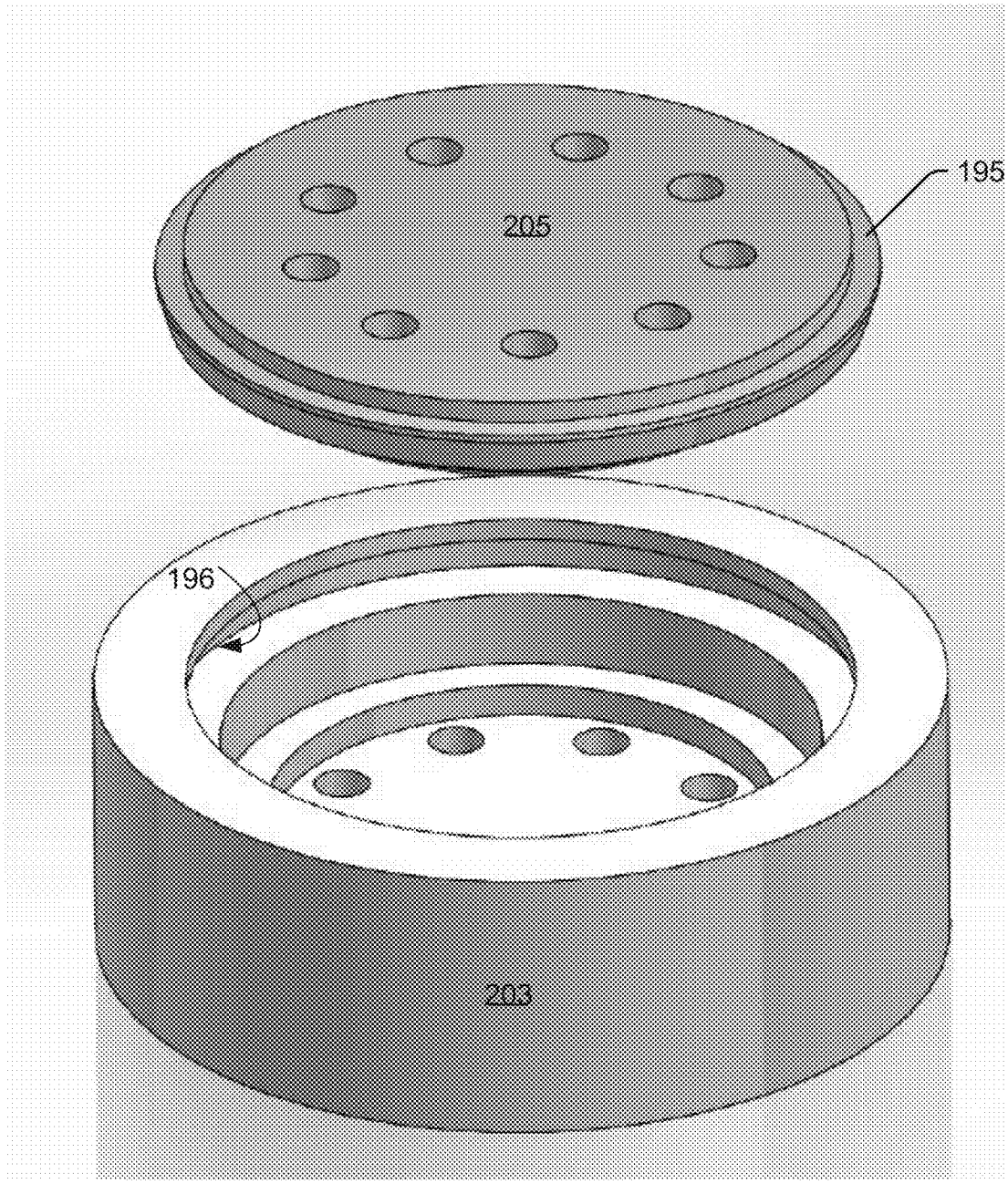
FIG. 34 illustrates an alternative configuration of subcomponents of a hockey puck according to a further embodiment of the present invention.
Figure 35:
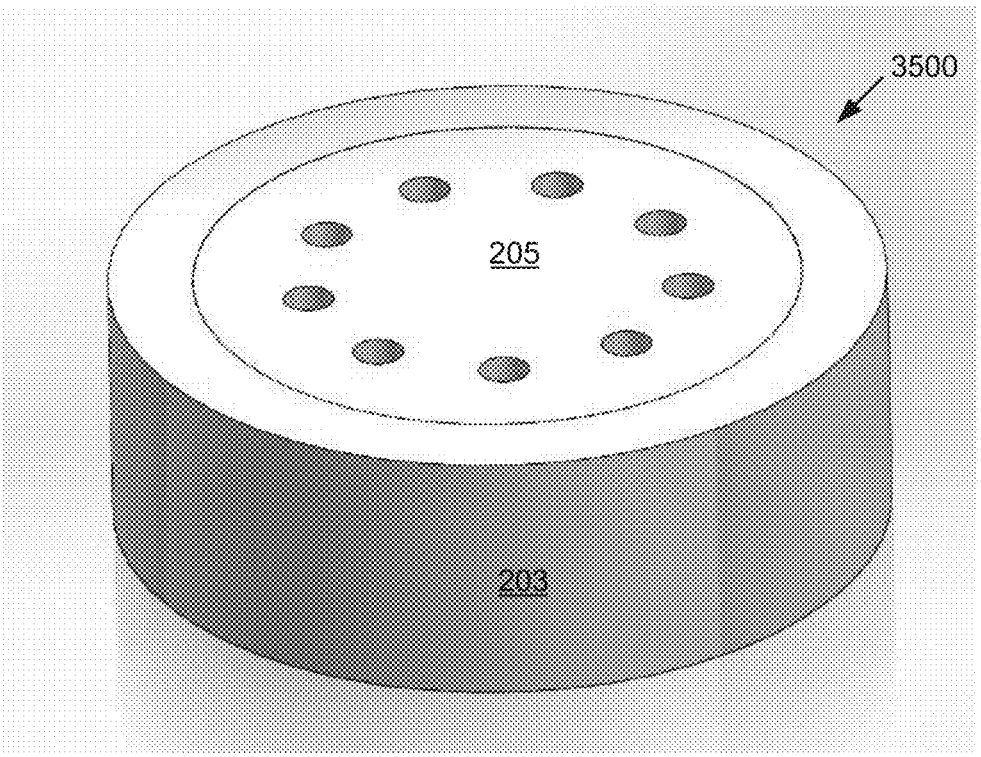
FIG. 35 illustrates an alternative configuration of subcomponents of a hockey puck according to a further embodiment of the present invention.
Figure 36:
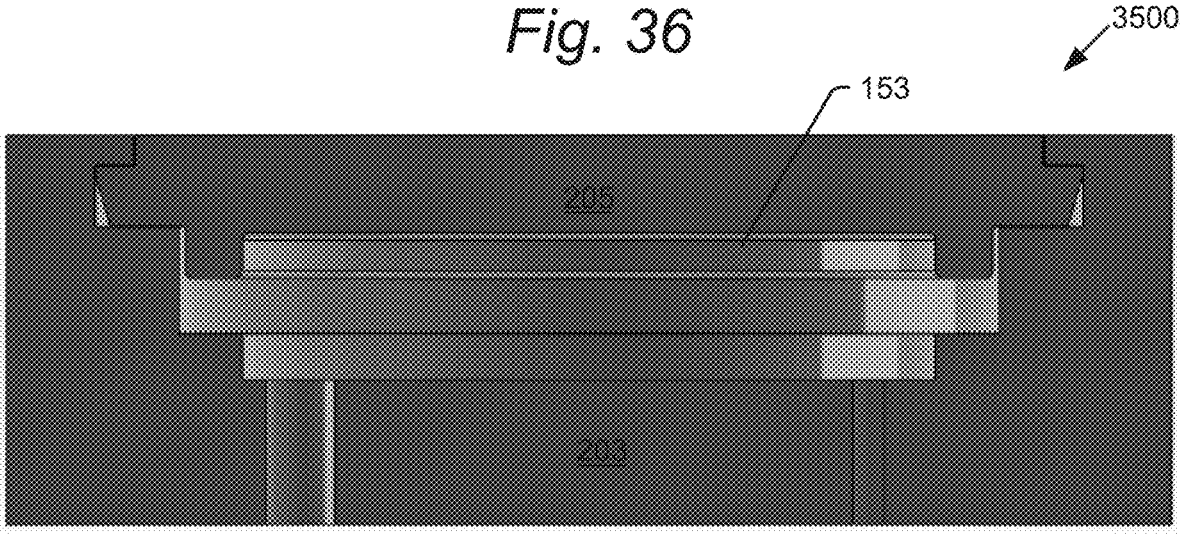
FIG. 36 illustrates an alternative configuration of subcomponents of a hockey puck according to a further embodiment of the present invention.

FIGS. 34-36 illustrate an embodiment of a subcomponent 205 including a lip 195 which snaps into an annular space 196 in the subcomponent 203 upon mating of the subcomponents 203, 205 in puck 3500.

Figure 38:
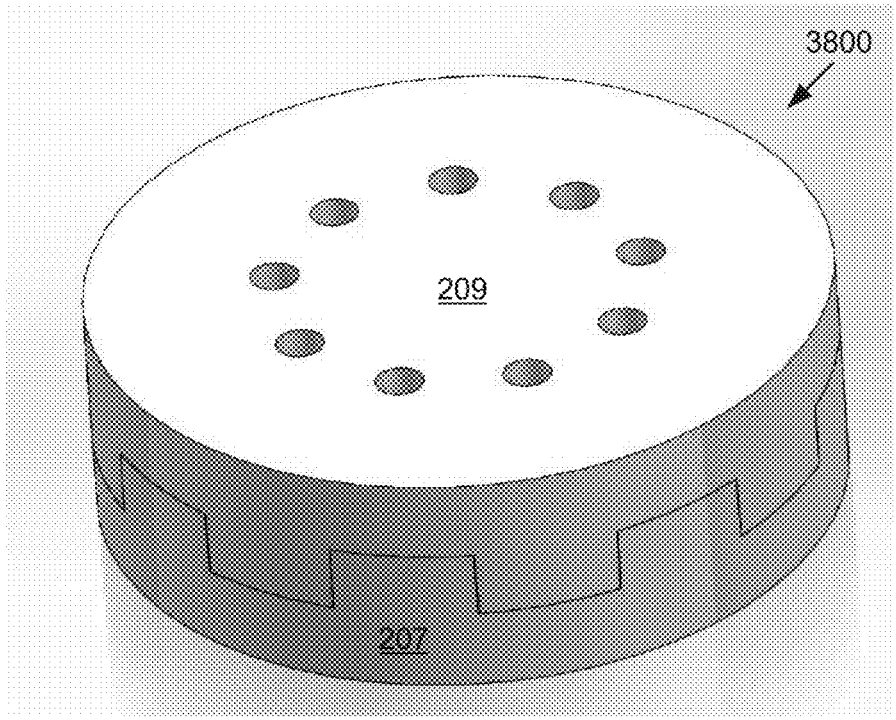
FIG. 38 illustrates an alternative configuration of subcomponents of a hockey puck according to a further embodiment of the present invention.
Figure 39:
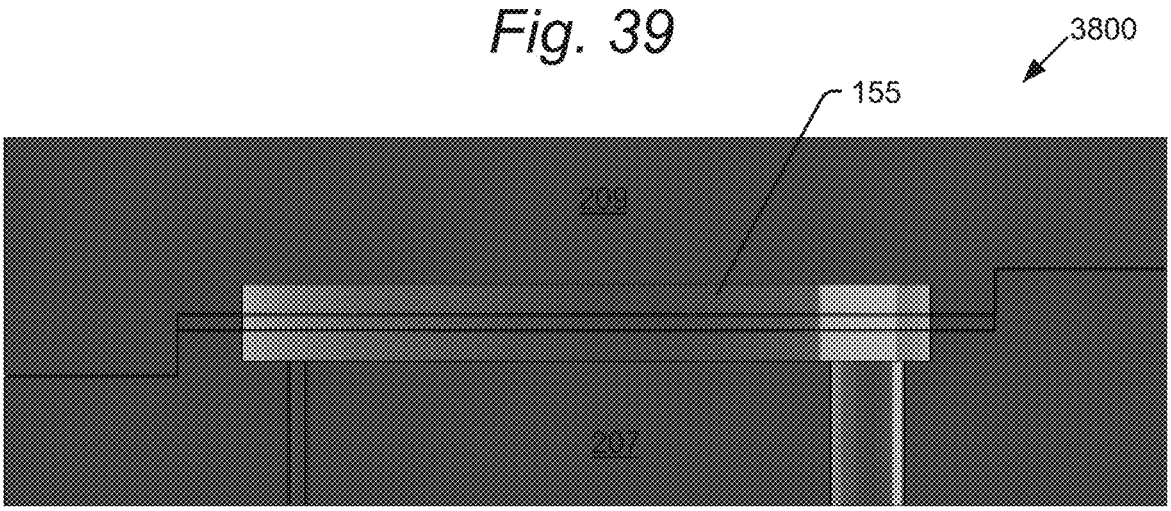
FIG. 39 illustrates an alternative configuration of subcomponents of a hockey puck according to a further embodiment of the present invention.

FIGS. 37-39 illustrate an embodiment of subcomponents 207, 209 forming a seam around the circumferential edge of the hockey puck 3800. In this embodiment, the upper subcomponent 209 is formed with downwardly-extending saw-tooth protrusions defined by vertical edges. These protrusions mate with upwardly-extending saw-tooth protrusions in the lower subcomponent 207 to form interleaved finger joints that make full surface contact between adjacent protrusions. The protrusions are tapered so that the edges that contact adjacent protrusions align along a radius of the puck, such that each protrusion is wider towards an exterior of the first and second subcomponents and narrower towards an interior of the first and second subcomponents, and wherein an interior end of each protrusion is curved.

Figure 40:
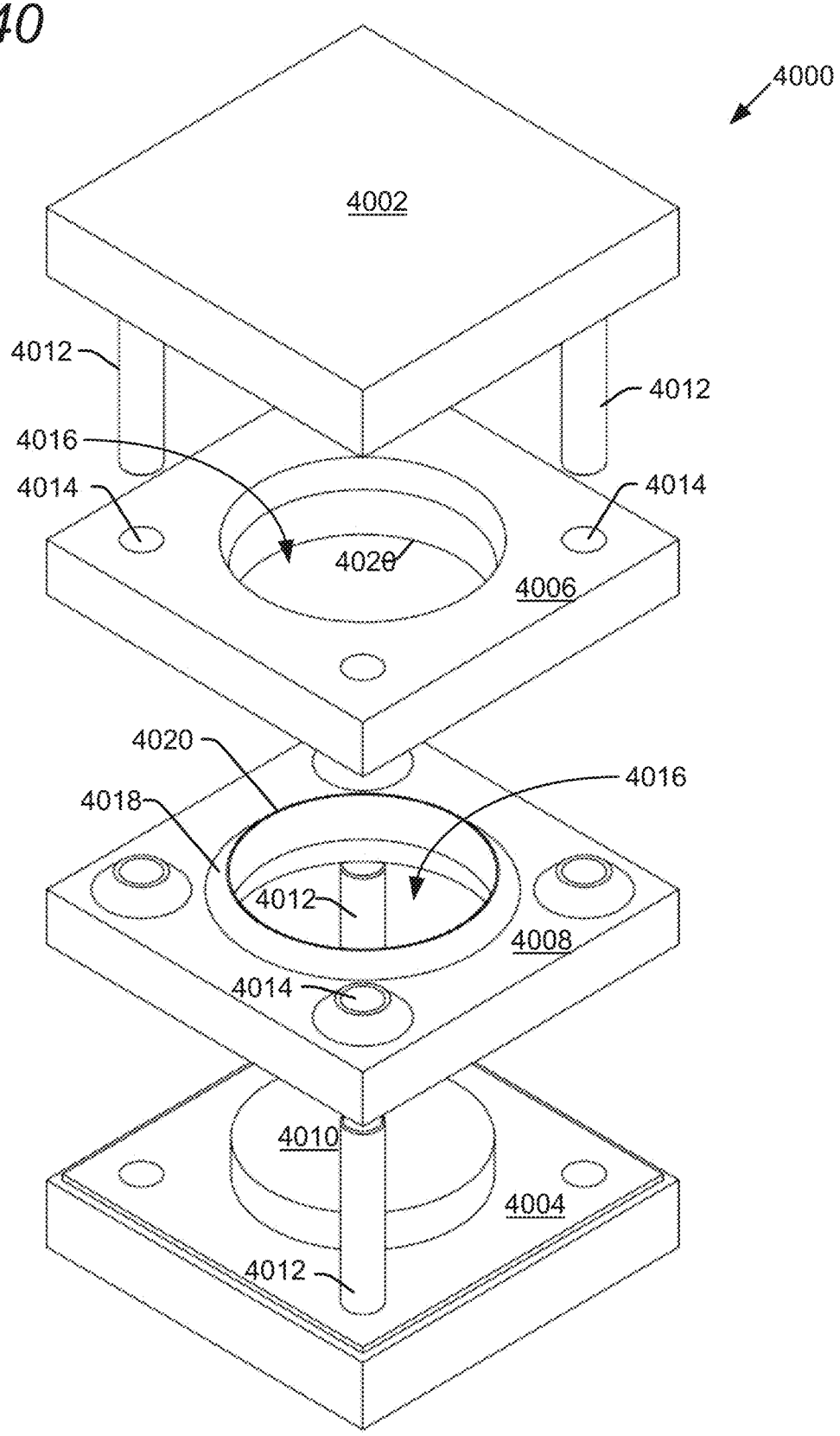
FIG. 40 is an exploded perspective view of a mold including mold plates and fixtures for use in gluing together subcomponents of the hockey puck according to an embodiment of the present invention.
Figure 42:
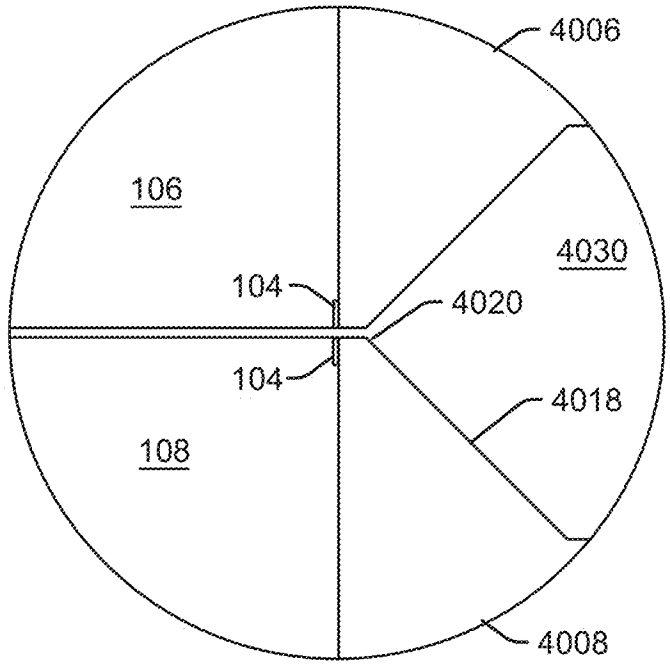
FIG. 42 is an enlarged view of area C from FIG. 41.
Figure 41:
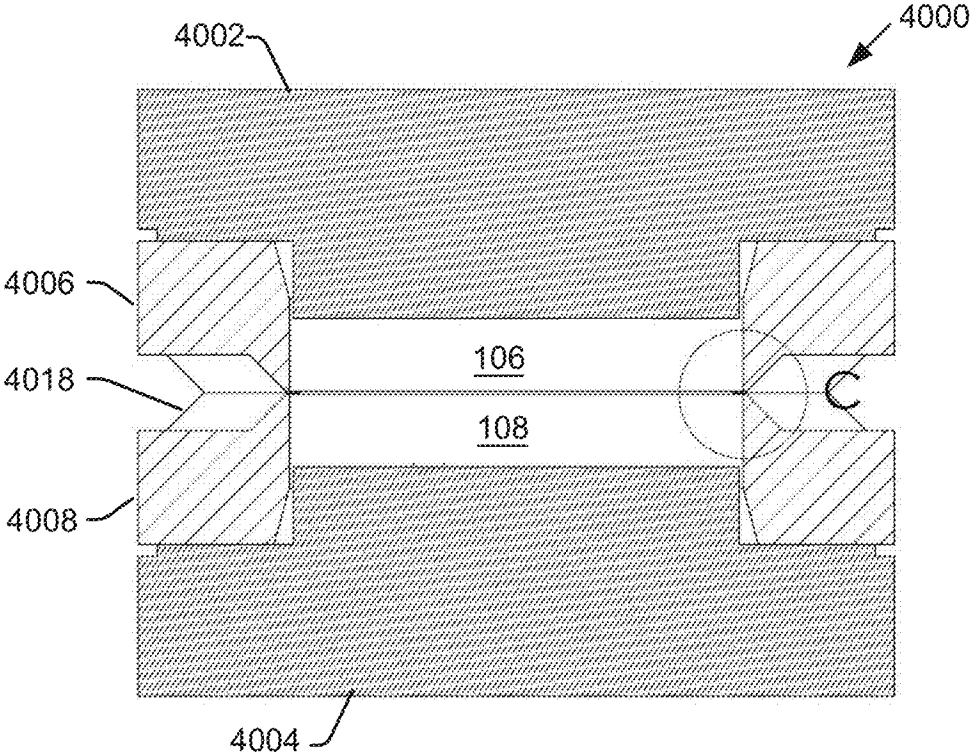
FIG. 41 is a cross-sectional view of the mold of FIG. 40 gluing together subcomponents of a hockey puck according to embodiments of the present invention.

FIGS. 40-42 illustrate a press 4000 for use in gluing together the subcomponents of the various embodiments shown in the figures. Press 4000 may include a top plate 4002 and a bottom plate 4004. Press 4000 may further include top fixture 4006 and bottom fixture 4008. The plates and fixtures of press 4000 may for example be formed of stainless steel.

In operation, a subcomponent, such as for example subcomponent 108, may be placed on a platform 4010 on the bottom plate 4004. The fixture 4008 may then be fit down over the bottom plate 4004 so that adjacent surfaces of the fixture 4008 and bottom plate 4004 lie contact with each other. The bottom plate 4004 may include a pair of upwardly extending guideposts 4012 received within guide holes 4014 in fixture 4008 to ensure precise alignment of the fixture 4008 on top of the bottom plate 4004.

The fixture 4008 includes a central opening 4016 which fits down over platform 4010. The central opening has a raised surface 4018 so that a height of the cylindrical walls of opening 4016 are equal to the height of the platform 4010 plus the height of the subcomponent 108 on top of platform 4010. An uppermost circular portion of the cylindrical walls of opening 4016 (where the raised surface 4018 meets the cylindrical walls) defines a lip 4020.

The top plate 4002 and top fixture 4006 have the same configurations and structures as lower plate 4004 and bottom fixture 4008, as indicated for example by those components which are numbered on top plate 4002 and top fixture 4006. The top plate and fixture 4002, 4006 may be turned upside down, and the second subcomponent, for example subcomponent 106, may then be placed on a platform 4010. The top fixture 4006 may then be fit over top plate 4002 to secure the subcomponent 106 in place as described above with respect to the bottom plate and fixture.

An adhesive material may then be applied to the features 130 (described above) on the interior surface(s) of subcomponent 106 and/or 108. The top plate 4002, top fixture 4006 and subcomponent 106 may then be flipped and fit on top of bottom plate 4004, bottom fixture 4008 and subcomponent 108. The guideposts 4012 in top plate 4002 fit through the guide holes in bottom fixture 4008. Similarly, the guideposts 4012 in bottom plate 4004 fit into guide holes 4014 in the top fixture 4006. This ensures proper alignment of all components in the press 4000, and proper alignment of the subcomponents 106 and 108 with respect to each other.

Thereafter, large compressive forces may be applied to the top and bottom plates 4002, 4004 by a hydraulic device (not shown) to press the features 130 on the interior surfaces of subcomponents 106, 108 against each other. The adhesive may then be cured under pressure for a period of time, and possibly at an elevated temperature. The adhesive may form a mechanical or chemical bond to seal the subcomponents 106, 108 together. The pressure may squeeze out any excess adhesive from between the subcomponents 106 and 108. The press 4000 may be heated during the gluing process to reduce the hydrostatic pressure generated by the glue as it is forced out from between the subcomponents 106, 108.

FIG. 41 is a cross-sectional view of the components of press 4000 sealing subcomponents 106 and 108 together. FIG. 42 is an enlarged sectional view of the area C of FIG. 41. As shown in FIGS. 41 and 42, when the bottom fixture 4008 is seated on top of bottom platform 4004, around subcomponent 108, the lip 4020 aligns snugly against the seam 104 in a top portion of the outer circumferential edge of subcomponent 108. Similarly, when the top fixture 4006 is seated on over of top plate 4002, around subcomponent 106, the lip 4020 aligns snugly against the seam 104 around a lower edge portion of the outer circumferential edge of subcomponent 106.

The tight engagement of the lip 4020 against the seam 104 in the subcomponents 106 and 108 ensures that, as glue is squeezed out from between subcomponents 106 and 108, the excess glue enters a space 4030 defined between the top and bottom fixtures 4006, 4008. Significantly, the tight engagement of the lip 4020 against the seam 104 prevents any excess glue from passing between the respective subcomponents and fixtures, onto the outer circumferential edge of the subcomponent 106 and/or 108. As discussed above, the outer circumferential edge of the hockey puck 100 may include a dimple pattern. The tight engagement of the lip 4020 against the seam 104 prevents adhesive from bleeding onto the dimple pattern.

Turning now to the fabrication of the subcomponents of hockey puck 100, the subcomponents may be formed of vulcanized rubber, for example containing natural rubber, oils for durability, minerals for curing and anti-aging agents, and coal dust (carbon black) for color. The various materials of the subcomponents may be thoroughly mixed together in predefined ratios, and then placed in a mold under pressure of a hydraulic press and cured, for example at 300° F. to 500° F. for 15 to 20 minutes. These temperatures and times are by way of example only, the curing temperatures and times may be lower or higher than the stated ranges in further embodiments.

The materials and ratios are controlled to provide the puck 100 with the same characteristics and properties as a conventional puck not having a signal transmitter core. For example, the signal transmitter in the hollow core tends to increase the amount by which the puck bounces off a surface as compared to a conventional puck. Thus, the materials and/or ratios may be controlled to be relatively energy absorbing so as to deaden the response of the subcomponents in comparison to the vulcanized rubber used in a conventional puck. In this way, the response of puck 100 including the signal transmitter core is the same as a conventional puck. It is understood that the materials and/or ratios may be varied, depending on whether the signal transmitter 110 is encased within a capsule 144 or sealed within the puck 100 without a capsule 144.

The subcomponents may be made in two pieces, and then glued around the signal transmitter 110 (as the signal transmitter may not withstand the curing conditions for the subcomponents if a single subcomponent were molded around the signal transmitter). However, in further embodiments, it is contemplated that the vulcanized rubber be molded in a single piece around the signal transmitter. In such embodiments, the signal transmitter maybe encased in a capsule as described above, or not encased in a capsule as described above. The press 4000 may form a single puck 100. Alternatively, the press may be elongated (or made into an x-y matrix) including multiple central openings 4016 and other components described above for receiving multiple pairs of subcomponents 106, 108, so that multiple pucks 100 may be formed in a single process.

In embodiments described above, the subcomponents include openings so that the electromagnetic radiation from the diodes may be transmitted through the subcomponents to an exterior of the puck 100. In embodiments, the vulcanized rubber of the subcomponents may include carbon black, which prevents the transmission of certain wavelengths of electromagnetic radiation, such as for example radiation in the IR wavelengths.

In further embodiments of the present technology, the puck may be formed of materials that are transparent to the wavelengths of the electromagnetic radiation emitted from the signal transmitter 157. In such embodiments, the axial openings and radial channels in the subcomponents may be omitted, and the electromagnetic radiation may be transmitted through the walls of the subcomponents. Such an embodiment is shown in the perspective view of FIG. 43.

Figure 43:
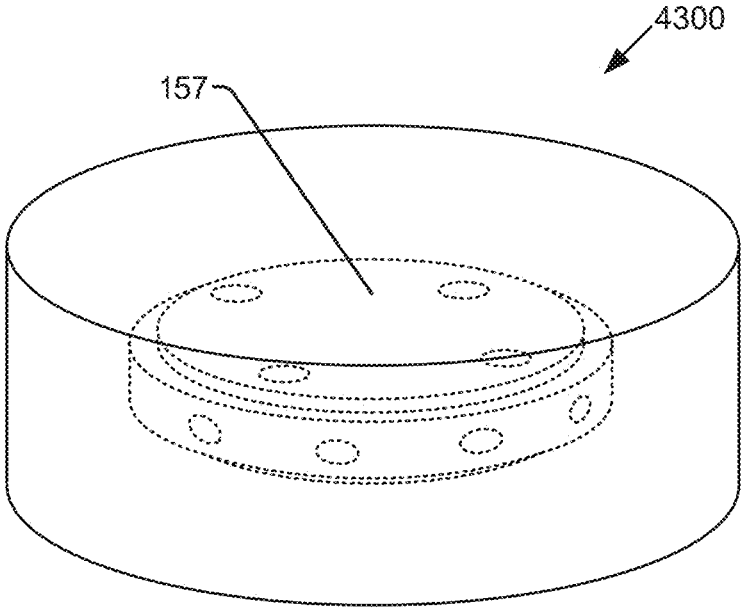
FIG. 43 is a perspective view of a puck according to a further embodiment of the present invention.

FIG. 43 shows a signal transmitter 157 encased within the interior of a puck 4300. The signal transmitter 157 may be as described above, and may or may not be encased within capsule. The puck 4300 of FIG. 43 may have the same color and other properties of a conventional hockey puck, but may for example be colored black without the use of carbon black. Other black-pigmented materials, such as for example powdered ash or other powdered materials, may be used in the vulcanized rubber to give the puck 4300 its black color. Without carbon black, the electromagnetic radiation from signal transmitter 157 may radiate from the puck 4300 without having to provide openings in the puck.

It is further conceivable that the signal transmitter transmits at wavelengths that are not blocked or absorbed by carbon black. In such embodiments, the vulcanized rubber of puck 100 may include carbon black.

In summary, embodiments of the present technology relate to a hockey puck, comprising: first and second subcomponents including complementary features operable to mate with each other, the first and second subcomponents together defining a central void interior to the first and second subcomponents together; a capsule sized and shaped to fit within the central void of the first and second subcomponents, the capsule including a central space interior to the capsule; and a signal transmitter sized and shaped to fit within the central space of the capsule, the signal transmitter operable to emit electromagnetic radiation to enable detection of an instantaneous position of the hockey puck.

In further embodiments, the present technology relates to a hockey puck, comprising: first and second subcomponents including complementary features operable to mate with each other, the first and second subcomponents together defining a central void interior to the first and second subcomponents together; and a signal transmitter sized and shaped to fit within the central void of the first and second subcomponents, the signal transmitter operable to emit electromagnetic radiation to enable detection of an instantaneous position of the hockey puck; wherein the first and second subcomponents comprise a first set of materials, the first set of materials absorbing a greater amount of energy than a second set of materials used in a second hockey puck having a solid core without the signal transmitter.

In other embodiments, the present technology relates to a hockey puck, comprising: first and second subcomponents including complementary features operable to mate with each other, the first and second subcomponents together defining a central void interior to the first and second subcomponents together; and a signal transmitter sized and shaped to fit within the central void of the first and second subcomponents, the signal transmitter operable to emit electromagnetic radiation in a wavelength band to enable detection of an instantaneous position of the hockey puck; wherein the first and second subcomponents comprise materials that are transparent to the wavelength band at which the electromagnetic radiation is emitted.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It is intended that the scope of the invention be defined by the claims appended hereto.

The invention claimed is:

1. A hockey puck, comprising:

a first subcomponent and a second subcomponent, wherein the first subcomponent and the second subcomponent are attached;

wherein the first subcomponent defines an exterior top surface of the hockey puck and the second subcomponent defines an exterior bottom surface of the hockey puck;

wherein the first subcomponent includes at least one opening and the second subcomponent includes at least one opening;

wherein the first subcomponent and the second subcomponent form an interior void;

wherein the first subcomponent and the second subcomponent include complementary features that fit together;

a capsule constructed and configured with a profile mated to contours of the interior void such that the capsule maintains an orientation within the interior void and does not move within the interior void;

a signal transmitter operable to generate and emit non-visible electromagnetic radiation operable to be received by a plurality of sensors around an ice rink regardless of an orientation of the hockey puck;

wherein the signal transmitter comprises at least one diode;

wherein the signal transmitter is sized and shaped to fit within a central void of the capsule wherein the signal transmitter is fixed within the central void of the capsule;

at least one light pipe extending outwardly from the capsule to at least one of the exterior top or bottom surfaces of the hockey puck in a direction substantially perpendicular to the exterior top or bottom surfaces of the hockey puck;

wherein the at least one light pipe is open to at least one of the exterior top or bottom surfaces of the hockey puck;

wherein the at least one light pipe does not extend beyond the exterior top surface or the exterior bottom surface of the hockey puck;

wherein the at least one light pipe is integrally formed with the capsule;

wherein the first subcomponent includes at least one raised key-point;

wherein the second subcomponent includes at least one raised key-point;

wherein the capsule includes a plurality of notches operable to receive the at least one raised key-point of the first subcomponent and the at least one raised key-point of the second subcomponent; and wherein the at least one light pipe is operable to receive the at least one diode of the signal transmitter and communicate the non-visible electromagnetic radiation from the at least one diode to the at least one opening of the first subcomponent and/or the at least one opening of the second subcomponent; and wherein the at least one opening of the first subcomponent and the at least one opening of the second subcomponent include detents corresponding to ridges on the at least one light pipe.

2. The hockey puck of claim 1, wherein the complementary features include a plurality of concentrically arranged wedges and a plurality of concentrically arranged valleys.

3. The hockey puck of claim 1, wherein physical characteristics of the hockey puck match physical characteristics of a conventional hockey puck used in the United States National Hockey League (NHL).

4. The hockey puck of claim 1, wherein the hockey puck has a thickness of approximately one inch and a diameter of approximately three inches.

5. The hockey puck of claim 1, wherein an outer circumference of the hockey puck includes a dimple pattern.

6. The hockey puck of claim 1, wherein the plurality of sensors around the ice rink are configured to communicate an instantaneous position of the hockey puck on the ice rink and communicate the instantaneous position of the hockey puck on the ice rink for display on a television monitor.

7. A hockey puck, comprising:

a first subcomponent and a second subcomponent, wherein the first subcomponent and the second subcomponent are attached;

wherein the first subcomponent defines an exterior top surface and the second subcomponent defines an exterior bottom surface of the hockey puck;

wherein the first subcomponent includes at least one opening and the second subcomponent includes at least one opening;

wherein the first subcomponent and the second subcomponent form an interior void, wherein the interior void includes a capsule, wherein the capsule is constructed and configured with a profile mated to contours of the interior void;

wherein the first subcomponent and the second subcomponent include complementary features that fit together and promote secure attachment;

at least one light pipe extending outwardly from the capsule in a direction substantially perpendicular to the exterior top or bottom surfaces;

wherein the at least one light pipe does not extend beyond the exterior top surface or the exterior bottom surface of the hockey puck;

wherein the at least one light pipe extends into at least one corresponding channel formed in the first subcomponent and/or the second subcomponent;

wherein the at least one light pipe is open to at least one of the exterior top or bottom surfaces of the hockey puck;

wherein the at least one light pipe is integrally formed with the capsule;

wherein the first subcomponent includes at least one raised key-point;

wherein the second subcomponent includes at least one raised key-point;

wherein the capsule includes a plurality of notches operable to receive the at least one raised key-point of the first subcomponent and the at least one raised key-point of the second subcomponent;

a signal transmitter operable to generate and emit non-visible electromagnetic radiation;

wherein the at least one light pipe is operable to receive a component of the signal transmitter and communicate the non-visible electromagnetic radiation from the component of the signal transmitter to the at least one opening of the first subcomponent and/or the at least one opening of the second subcomponent; and wherein the hockey puck is cylindrical.

8. The hockey puck of claim 7, wherein the complementary features include a plurality of wedges and a plurality of valleys.

9. The hockey puck of claim 7, wherein physical characteristics of the hockey puck match physical characteristics of a conventional hockey puck used in the United States National Hockey League (NHL).

10. The hockey puck of claim 7, wherein the hockey puck has a thickness of approximately one inch and a diameter of approximately three inches.

11. The hockey puck of claim 7, wherein an outer circumference of the hockey puck includes a dimple pattern.

12. The hockey puck of claim 7, wherein the non-visible electromagnetic radiation generated and emitted by the signal transmitter is operable to be received by a plurality of sensors around an ice rink regardless of an orientation of the hockey puck, wherein the plurality of sensors around the ice rink are configured to communicate an instantaneous position of the hockey puck on the ice rink and communicate the instantaneous position of the hockey puck on the ice rink for display on a television monitor, wherein the hockey puck is highlighted in a color on the television monitor.

* * * * *